US011294313B2

(12) United States Patent
Hasegawa et al.

(10) Patent No.: US 11,294,313 B2
(45) Date of Patent: Apr. 5, 2022

(54) IMAGE FORMING APPARATUS

(71) Applicant: CANON KABUSHIKI KAISHA, Tokyo (JP)

(72) Inventors: Mitsuru Hasegawa, Ibaraki (JP); Hiroki Kawai, Chiba (JP); Yasuharu Toratani, Chiba (JP); Ayano Ogata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/215,907

(22) Filed: Mar. 29, 2021

(65) Prior Publication Data

US 2021/0302879 A1 Sep. 30, 2021

(30) Foreign Application Priority Data

Mar. 31, 2020 (JP) ..... JP2020-063489

(51) Int. Cl.
*G03G 15/20* (2006.01)

(52) U.S. Cl.
CPC ..... *G03G 15/205* (2013.01); *G03G 15/2053* (2013.01); *G03G 15/2064* (2013.01); *G03G 2215/2032* (2013.01); *G03G 2215/2041* (2013.01)

(58) Field of Classification Search
CPC ..... G03G 15/205; G03G 15/2053; G03G 15/2064; G03G 2215/2032; G03G 2215/2041
See application file for complete search history.

(56) References Cited

U.S. PATENT DOCUMENTS

| | | | | |
|---|---|---|---|---|
| 8,005,414 | B2 | 8/2011 | Hasegawa | 399/331 |
| 8,818,254 | B2 | 8/2014 | Arimoto et al. | 399/329 |
| 8,917,999 | B2 | 12/2014 | Takada et al. | 399/43 |
| 8,918,003 | B2 | 12/2014 | Kawai et al. | 399/69 |
| 8,929,762 | B2 | 1/2015 | Shinagawa et al. | 399/69 |
| 8,971,746 | B2 | 3/2015 | Hasegawa et al. | 399/67 |
| 8,989,640 | B2 | 3/2015 | Kitagawa et al. | 399/320 |
| 9,235,168 | B2 | 1/2016 | Kawai | G03G 15/2053 |
| 9,329,557 | B2 | 5/2016 | Kitagawa et al. | G03G 15/2014 |
| 9,392,642 | B2 | 7/2016 | Tanaka et al. | H05B 1/00 |

(Continued)

FOREIGN PATENT DOCUMENTS

| | | | | |
|---|---|---|---|---|
| JP | 2001-100589 | | 4/2001 | |
| JP | 2002287563 | A * | 10/2002 | H05B 6/145 |

(Continued)

OTHER PUBLICATIONS

U.S. Appl. No. 17/323,365, filed May 18, 2021.
U.S. Appl. No. 17/330,619, filed May 26, 2021.

*Primary Examiner* — Sevan A Aydin
(74) *Attorney, Agent, or Firm* — Venable LLP

(57) ABSTRACT

An image forming apparatus includes a heater, heating roller heated by the heater and a fixing belt heated by the heating roller. A thermistor detects a temperature of the fixing belt at an area where the belt is stretched by the heating roller. When a CPU receives a signal which instructs the stop of rotation of the fixing belt, the CPU continues rotation of the fixing belt until the detected temperature detected by the thermistor decreases a predetermined temperature in a case in which the detected temperature is higher than the predetermined temperature.

18 Claims, 22 Drawing Sheets

(56) References Cited

U.S. PATENT DOCUMENTS

| | | | | |
|---|---|---|---|---|
| 9,977,385 | B2 | 5/2018 | Miura et al. | G03G 15/2053 |
| 10,133,219 | B2 | 11/2018 | Kawai | G03G 15/55 |
| 10,241,433 | B2 | 3/2019 | Tanaka et al. | G03G 13/20 |
| 10,241,455 | B2 | 3/2019 | Fukamachi et al. | G03G 15/2039 |
| 10,437,185 | B2 | 10/2019 | Yamaguchi et al. | G03G 15/5004 |
| 10,627,751 | B2 | 4/2020 | Hasegawa et al. | G03G 15/2021 |
| 10,802,430 | B2 | 10/2020 | Toratani et al. | G03G 15/2053 |
| 10,845,742 | B2 | 11/2020 | Kawai et al. | G03G 15/2028 |
| 10,871,735 | B2 | 12/2020 | Kawai et al. | G03G 15/205 |
| 10,955,775 | B2 | 3/2021 | Kawai et al. | G03G 15/2017 |
| 2013/0142532 | A1 | 6/2013 | Kitagawa et al. | 399/67 |
| 2020/0310309 | A1* | 10/2020 | Kawai | G03G 15/2039 |
| 2021/0141322 | A1 | 5/2021 | Tatezawa et al. | G03G 15/2057 |
| 2021/0191298 | A1 | 6/2021 | Takemasa et al. | G03G 15/2064 |
| 2021/0191299 | A1 | 6/2021 | Takemasa et al. | G03G 15/2064 |

FOREIGN PATENT DOCUMENTS

| | | | | |
|---|---|---|---|---|
| JP | 2013174870 A * | 9/2013 | | G03G 15/80 |
| JP | 2014-142398 | 8/2014 | | |

* cited by examiner

| TEMP DEF IN BELT ROATATION DIREC | 60 | 70 | 80 | 90 |
|---|---|---|---|---|
| BUCKLING | ○ | ○ | ○ | × |

Fig. 8

IMAGE FORMING APPARATUS

FIELD OF THE INVENTION AND RELATED ART

The present invention relates to an image forming apparatus such as a copying machine, a printer, a facsimileing machine, and a multifunction machine capable of functioning as two or more of the preceding image forming apparatuses.

An image forming apparatus has a fixing apparatus for fixing a toner image to recording medium by heating the toner image borne by the recording medium. There have been known fixing apparatuses which employ a belt which is kept suspended and tensioned by two or more suspending-tensioning members (Japanese Laid-open Patent Application No. 2014-142398). In the case of the fixing apparatus structured as disclosed in Japanese Laid-open Patent Application No. 2014-142398, a heat roller which internally holds a halogen heater is used as the suspending-tensioning roller for heating the belt.

In the case of the fixing apparatus structured as disclosed in Japanese Laid-open Patent Application No. 2014-142398 heats its belt by a heat roller in an area in terms of the direction in which the belt is rotationally moved, it is possible that the portion of the belt, which is in the belt heating area, and the portion of the belt, which is outside the belt heating area, will become substantially different in temperature. For example, as a belt which is being rotated while being heated is stopped, the portion of the belt, which is in contact with the heat roller, and the portion of the belt, which is not in contact with the heat roller, are likely to become substantially different in temperature. This phenomenon is more apparent in the case of a fixing apparatus structured so that its heat roller is substantially larger in thermal capacity than its belt. Thus, various solutions have been proposed to solve this problem. According to the solution disclosed in Japanese Laid-open Patent No. 2001-100589, the fixing apparatus is structured so that after the completion of an image forming operation, the heater is turned off, but the belt rotation is continued until the fixation belt falls in temperature to a preset value. This structural arrangement can prevent the problem that a fixing apparatus increases in belt temperature after the stopping of the belt at the end of an image forming operation.

However, it became evident that if a signal to turn off the electric power source for a fixing apparatus, or a signal to change the fixing apparatus in operational mode from the image formation mode to the sleep mode, that is, low power consumption mode, in which the image forming apparatus is kept on standby, is inputted while the belt is rotated, is prioritized, that is, the rotation of the belt is simply stopped in response to the signal, it is likely for the belt to be made to significantly deteriorate.

SUMMARY OF THE INVENTION

Thus, the primary object of the present invention is to provide a fixing apparatus, the belt of which does not stop while the belt is high in temperature, even if a signal to turn off the power source for the fixing apparatus, or a signal to put the fixing apparatus in the sleep mode is inputted while the belt of the fixing apparatus is rotated.

According to an aspect of the present invention, there is provided an image forming apparatus comprising: a rotatable belt configured to fix a toner image on a recording material; a pressing member configured to feed and nip the recording material with said belt; a heating roller including a heater inside and configured to suspend and tension, and heat said belt; a temperature detecting member configured to detect a temperature of said heating roller or a temperature of said belt at an area where said belt is into contact with said heating roller; a suspending-tensioning member configured to stretch said belt; a drive source configured to rotate said belt; a control portion configured to control said drive source; and a receiving portion configured to receive a power OFF signal of said image forming apparatus, wherein said control portion, in a case in which the temperature detected by said temperature detecting member does not reach a predetermined condition when said receiving portion receives the OFF signal of said image forming apparatus during a rotation of said belt, controls to de-energize said heater and to continue the rotation of said belt, and then controls to turn off the power of said image forming apparatus in a case in which the temperature detected by said temperature detecting member reaches the predetermined condition.

Further features of the present invention will become apparent from the following description of exemplary embodiments (with reference to the attached drawings).

BRIEF DESCRIPTION OF THE DRAWINGS

FIG. 8 is a table which shows the relationship between the amount of nonuniformity in the temperature of the fixation belt in terms of the rotational direction of the belt, and the bucking of the belt.

DESCRIPTION OF THE EMBODIMENTS

Embodiment 1

Figure 1:
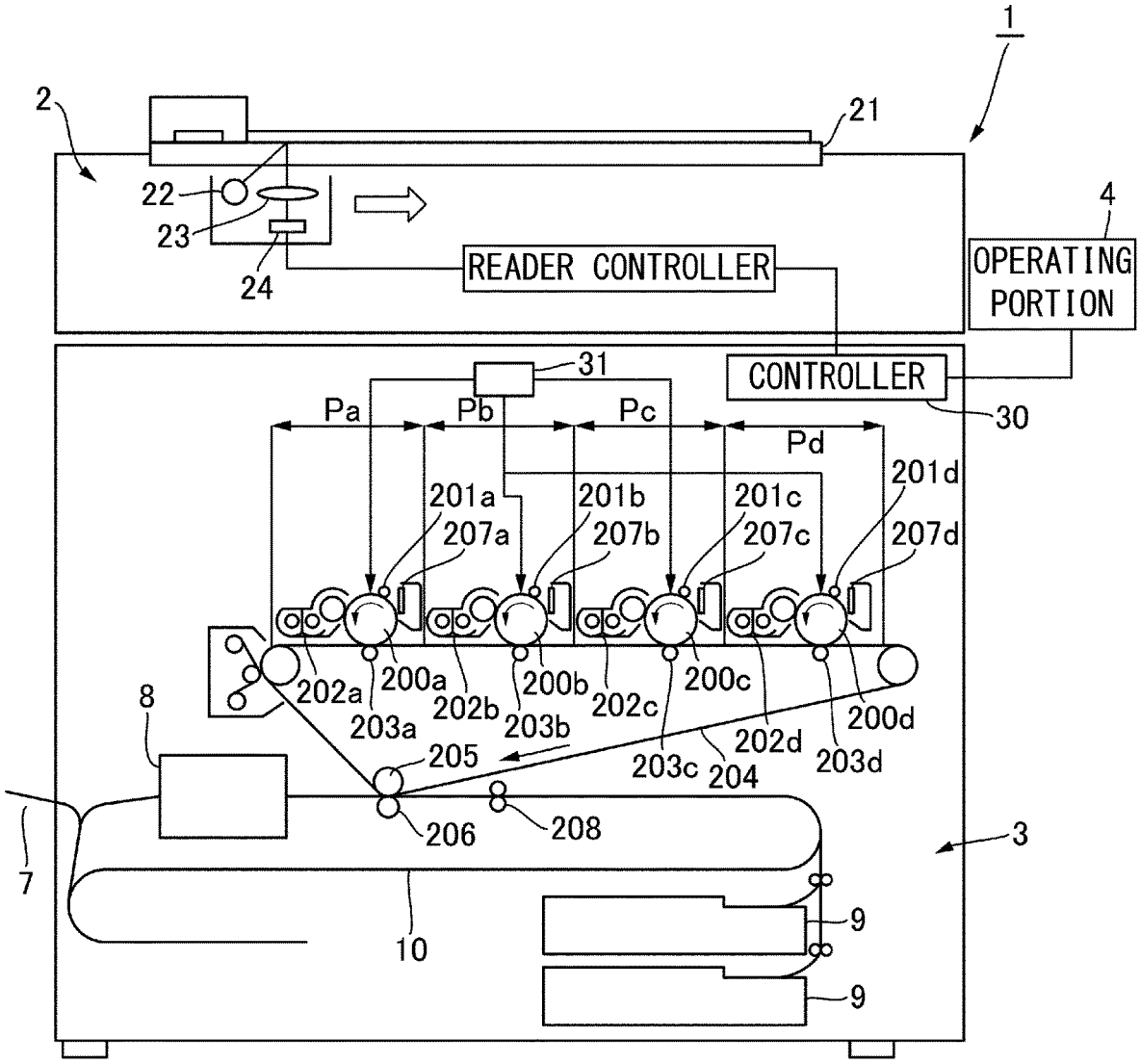
FIG. 1 is a schematic sectional view of the image forming apparatus in the first embodiment of the present invention; it shows the general structure of the apparatus.

Referring to FIGS. 1-13, the first embodiment of the present invention is described. First, the image forming apparatus in the first embodiment is described about its general structure.

[Image Forming Apparatus]

An image forming apparatus 1 is an electrophotographic full-color printer having four image forming portions Pa, Pb, Pc and Pd which correspond in color to yellow, magenta, cyan and black, respectively. The image reading apparatus 1 in this embodiment is of the so-called tandem type. That is, it is an image forming apparatus structured so that the four image forming portions are aligned in tandem in the direction in which its intermediary transfer belt 204 is circularly driven. It forms an image on recording medium in response to image signals from an image reading portion 2 (document (original) reading apparatus) which is in connection to the main assembly 3 of the image forming apparatus 1 (which hereafter will be referred to as apparatus main assembly), or a host device such as a personal computer which is in such connection to apparatus main assembly 3 that communication is possible between the two. As recording medium, a sheet of ordinary paper, plastic film, fabric, or the like can be listed.

The image forming apparatus 1 has the image reading portion 2, and main assembly 3. The image reading portion 2 reads an original on an original placement glass platen 21. More specifically, a beam of light projected from a light source 22 is reflected by the original, and then, the reflected beam of light is focused on a CCD sensor 24 by way of an optical member 23 such as a lens. An optical system unit such as the one mentioned above converts the image of an original into electrical signals by scanning the original in the direction indicated by an arrow mark; the original is divided into a preset number of fine linear sections, each of which is convertible into sequential electrical signals (image data). The image signals obtained by the CCD sensor 24 are sent to the main assembly 3 of the image forming apparatus 1, and are processed by the controlling portion 30 the image forming apparatus 1 so that they can be used by corresponding image forming portions, which will be described later. Further, the controlling portion 30 can accept inputs, as image signals, from an external host device such as a print server.

The main assembly 3 of the image forming apparatus 1 is provided with multiple image forming portions Pa, Pb, Pc and Pd, in each of which an image is formed based on the above described image signals. That is, the image signals are used by the controlling portion 30 to modulate a beam of laser light (PWM: pulse width modulation). A polygon scanner 31, which is an exposing apparatus, scans the peripheral surface of a photosensitive drum 200 (200*a*, 200*b*, 200*c* or 200*d*), which is an image bearing member of image forming portion P (Pa—Pd), with the beam of laser light, which is being modulated with the image signals.

By the way, Pa, Pb, Pc and Pd stand for yellow (Y), magenta (M), cyan (C) and black image forming portions, respectively. The image forming portions Pa~Pd are roughly the same in structure. Thus, only the image forming portion Y will be described in detail; other image forming portions are not described. In the image forming portion Pa, a toner image is formed on the photosensitive drum 200*a*, based on the image signals, as will be described next.

A charge roller 201*a*, which is the primary charging device, uniformly charges the peripheral surface of the photosensitive drum 200*a* to a preset potential level to prepare the photosensitive drum 200*a*, for the formation of an electrostatic latent image. An electrostatic latent image is formed on the peripheral surface of the photosensitive drum 200*a*, which has just been charged to the preset potential level, by the beam of laser light from the polygon scanner 31. A developing device 202*a* develops the electrostatic latent image on the photosensitive drum 200*a*, into a toner image. A primary transfer roller 203*a* transfers the toner image on the photosensitive drum 200*a* onto the intermediary transfer belt 204, by applying the primary transfer bias, which is opposite in polarity from toner, from the back side of the intermediary transfer belt 204. After the transfer, the photosensitive drum 200*a* is cleaned across its peripheral surface by a cleaner 2007*a*.

The toner image on the intermediary transfer belt 204 is conveyed to the next image forming portion, and so on. Thus, the yellow (Y), magenta (M), cyan (C) and black (B) toner images formed in the corresponding image forming portions are sequentially transferred in layers onto the intermediary transfer belt 204, forming a color toner image. Then, after being conveyed through the image forming portion Pd, the color toner image is conveyed to the secondary transferring portion, which is the most downstream image forming portion in terms of the rotational direction of the intermediary transfer belt 204. In the secondary transferring portion, the color toner image is transferred (secondary transfer) onto a sheet of recording medium by the application of the secondary transfer electric field, which is opposite in polarity from the toner image on the intermediary transfer belt 204.

There are multiple sheets of recording medium stored in a cassette 9 to be fed into the apparatus main assembly 3. As a sheet of recording medium is fed into the apparatus main assembly 3 from the cassette 9, it is conveyed to a registering portion 208 which comprises a pair of registration rollers, for example. Then, it is kept on standby at the registering portion 208. Thereafter, the sheet is conveyed to the secondary transferring portion by the registering portion 203, with such timing that the color toner image on the intermediary transfer belt 204 is matched in position with the sheet.

After the transfer of the toner image onto the sheet of recording medium in the secondary transferring portion, the sheet is conveyed to a fixing apparatus 8, in which the toner image on the sheet is fixed to the sheet, by being heated while being pressed. Consequently the toner image becomes fixed to the sheet. After being conveyed through the fixing apparatus 8, the sheet is discharged into a delivery tray 7. By the way, in a case where an image is to be formed on both surfaces of a sheet of recording medium, as soon as the transfer of a toner image onto the first surface of the sheet, and the fixation of the toner image to the sheet, are finished, the sheet is conveyed through a reversal conveyance portion to be placed upside down. Then, another toner image is transferred onto the second surface (back surface) of the sheet, and fixed. Then, the sheet is discharged into the delivery tray 7 to be laid upon the sheets in the tray 7.

[Fixing Apparatus]

Figure 2:
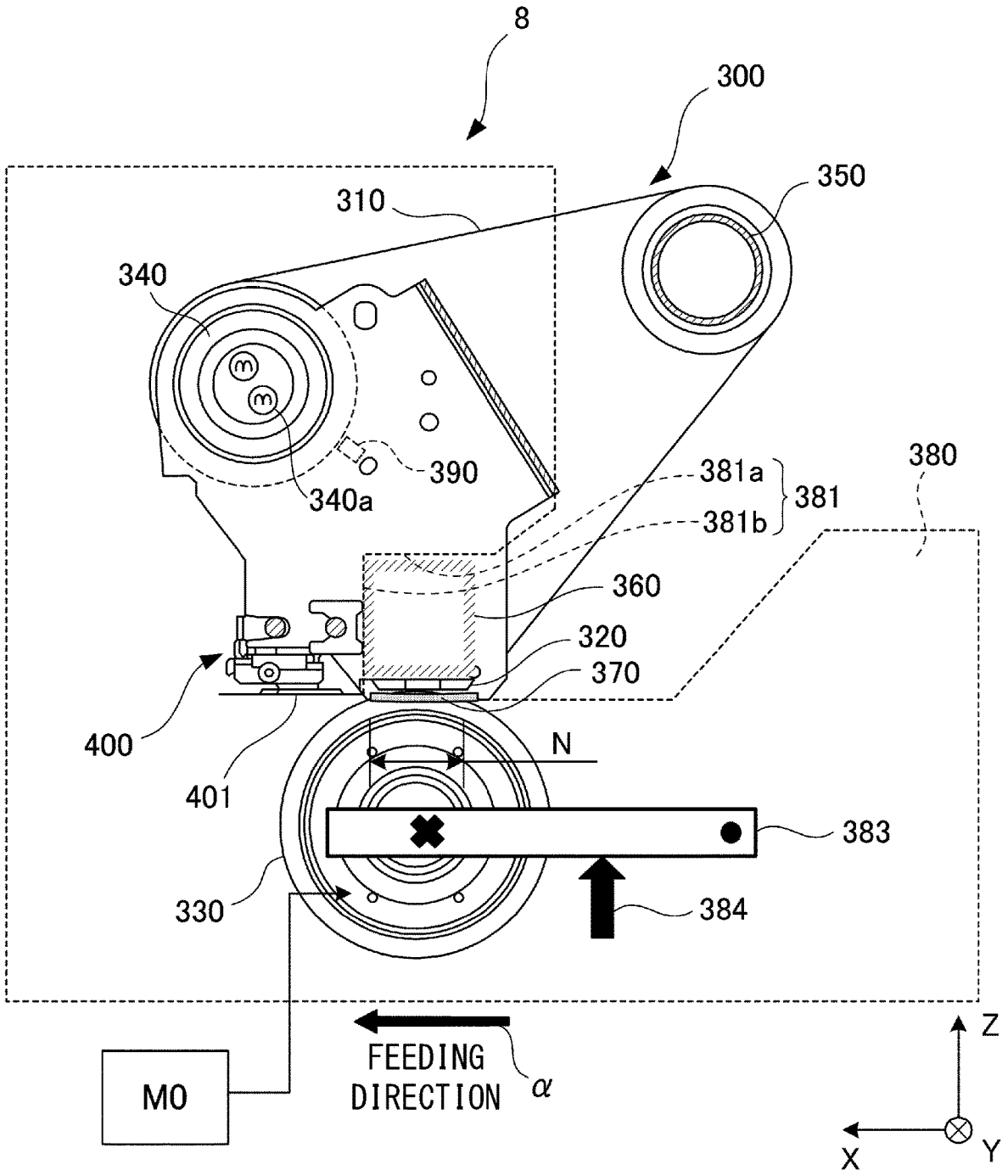
FIG. 2 is a schematic sectional view of the fixing apparatus in the first embodiment; it shows the general structure of the apparatus.

Next, referring to FIG. 2, the fixing apparatus 8 in this embodiment is described about its structure. The fixing apparatus 8 in this embodiment is of the so-called belt heating type, which employs an endless belt. A sheet of recording medium is conveyed through the fixing apparatus 8 in the right-to-left direction as shown by an arrow mark a in FIG. 2. The fixing apparatus 8 has a heating unit 300 and a pressure roller 330. The heating unit 300 has a fixation belt 310 which is endless and rotationally drivable. The pressure roller 330 is a pressure applying rotational member (pressing member), which forms a nip N in coordination with the fixation belt 310.

The heating unit 300 has: the fixation belt 310 described above, and a fixation pad 320 as a nip forming member. It has also a heat roller 340 and a steering roller 350, by which the fixation belt 310 is suspended and kept tensioned. The pressure roller 330 doubles as a driver roller that rotates in contact with the outward surface of the fixation belt 310, to drive the fixation belt 310.

The fixation belt 310, which is an endless belt, is thermally conductive, and heat resistant. It is 120 mm, for example, in internal diameter. It is thin and cylindrical. In this embodiment, the fixation belt 310 comprises three layers, that is, a substrate layer, an elastic layer which is on the substrate layer, and a release layer which is on the outward surface of the elastic layer. The substrate layer is 60 μm in thickness. It is formed of polyimide resin (PI). The elastic layer is 300 μm in thickness. It is formed of silicone rubber. The release layer is 30 μm in thickness. It is formed of fluorine resin, more specifically, PFA (tetrafluoroethylene/perfluoro-alkoxyethylene copolymer resin). The fixation belt 310 structured as described above is suspended and kept tensioned by multiple suspending-tensioning members, more specifically, a fixation pad 320, a heat roller 340, and a steering roller 350. That is, the multiple suspending-tensioning member, which keep the fixation belt 310 suspended and tensioned, include two suspending-tensioning rollers, and a fixation pad 320 as padding member. In this embodiment, the two suspending-tensioning members are the heat roller 340 and steering roller 350.

The fixation pad 320 is positioned on the inward side of the loop which the fixation belt 310 forms. Further, it is positioned in such a manner that it opposes the pressure roller 330 with the presence of the fixation belt 310 between itself and pressure roller 330, forming a nip N, through which a sheet of recording medium is conveyed while remaining pinched between the fixation belt 310 and pressure roller 330. In this embodiment, the fixation pad 320 is roughly in the form of a rectangular board, the lengthwise edges of which are parallel to the widthwise direction of the fixation belt 310 (lengthwise direction, which is perpendicular to rotational direction of fixation belt 310; direction which is parallel to rotational directional axis of heat roller 340). Because the fixation pad 320 is pressed against the pressure roller 330 with the presence of the fixation belt 310 between the fixation pad 320 and pressure roller 330, the nip N is formed. The fixation pad 320 is formed of LCP (liquid polymer) resin.

The fixation pad 320 is shaped so that at least a part of its nip forming portion is flat. That is, the portion of the surface of the fixation pad 320, which is pressed against the inward surface of the fixation belt 310, with the presence of a lubrication sheet 370 between itself and fixation belt 310 is roughly flat. Thus, the nip is roughly flat. Since the fixing apparatus 8 is structured as described above, it can be prevented that in a case where a toner image is fixed to an envelop as recording medium, the envelop is wrinkled and/or an image is displaced.

The fixation pad 320 is supported by a stay 360 as a supporting member positioned on the inward side of the fixation belt loop. That is, the stay 360 is positioned on the opposite side of fixation pad 320 from the pressure roller 330, and supports the fixation pad 320. The stay 360 described above is a rigid reinforcing member, the lengthwise direction of which is parallel to the widthwise direction of the fixation belt 310. It backs up the fixation pad 320 by being placed in contact with the fixation pad 320. That is, the stay 360 is for providing the fixation pad 320 with rigidity to ensure that the fixation pad 320 can withstand the pressure applied thereto by the pressure roller 330.

The stay 360 is made of a metallic substance such as stainless steel. It is roughly rectangle at a plane (cross-sectional view) which is perpendicular to the lengthwise direction of the stay 360, which is perpendicular to the rotational direction of the fixation belt 310. For example, the stay 360 is formed of a piece of drawn SU304 (stainless steel) which is 3 mm in thickness. It is hollow, and is made square in cross-section to provide it with a sufficient amount of rigidity. By the way, it may be formed of multiple pieces of metallic plate welded together. Further, it is not mandatory that the material for the stay 360 is stainless. That is, the material for the stay 360 may be any substance as long as the substance can provide the stay 360 with a sufficient amount of strength.

Figure 3:
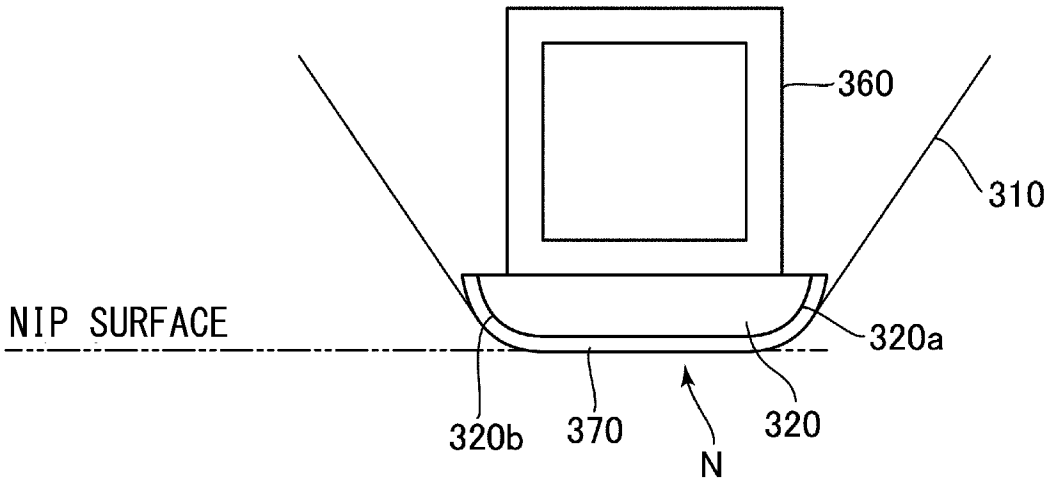
FIG. 3 is a drawing for showing the relationship between the fixation pad and fixation belt.

Next, referring to FIG. 3, in terms of the direction in which recording medium is conveyed through the nip N, the end portions 320*a* and 320*b* of the fixation pad 320 are upwardly bent in curvature, in such a manner that the farther it is from the nip in terms of the recording medium conveyance direction, the greater is the distance between the end portions 320*a* and 320*b* and the surface which coincides with the nip N. The nip N is between the fixation belt 310 and pressure roller 330, and coincides with the surface of the fixation pad 320, which is on the fixation roller side (bottom surface in FIG. 3).

As described above, in this embodiment, the downward end portion 320*b* of the fixation pad 320 is upwardly bent in curvature to make the fixation belt 310 upwardly bent in curvature by the curvature of the downward end portion of the fixation pad 320, so that as a sheet of recording medium comes out of the nip N, it is separated from the fixation belt 310 by the curvature of the fixation belt 310.

There is provided a lubrication sheet 370 between the fixation pad 320 and fixation belt 310. In this embodiment, the lubrication sheet 370 is a piece of PI (polyimide) coated with PTFE (polyfluoroethylene). It is 100 μm in thickness. The PI sheet is provided with countless minute projections, which are 100 μm tall and are apart from each other by 1 mm, to reduce the friction between the fixation pad 320 and fixation belt 310 by reducing the area of contact between the lubrication sheet 370 and fixation belt 310.

Further, the inward surface of the fixation belt 310 is coated with lubricant so that the fixation belt 310 smoothly slides on the fixation pad 320 covered with the lubricant sheet. As lubricant, silicone oil is used.

Referring to FIG. 2, the heat roller 340, which is a suspending-tensioning member, is one of the multiple suspending-tensioning members. It is positioned on the inward side of the fixation belt 310 loop. It suspends and keeps the fixation belt 310 tensioned, in coordination with the front cover 20 and steering roller 350. As described above, the inward surface of the fixation belt 310 is coated with lubricant. Therefore, the heat roller 340 suspends and tensions the fixation belt 310, with the presence of this lubricant between the heat roller 340 and fixation belt 310. Further, in terms of the direction in which the fixation belt 310 rotates, the heat roller 340 is on the downstream side of the fixation pad 320, and on the upstream side of the steering roller 350. By the way, the fixing apparatus 8 may be structured so that the heat roller 340 doubles as an auxiliary drive roller for driving the fixation belt 310 by being driven by a motor.

The heat roller 340 is made of a metallic substance such as aluminum and stainless steel. It is cylindrical. There is provided a halogen heater 340*a* as a means for heating the fixation belt 310, in the hollow of the heat roller 340. That is, the halogen heater 340*a* is positioned within the heat roller 340 (suspending-tensioning roller). The heat roller 340 is heated to a preset temperature level by the halogen heater 340*a*. The heat roller 340 described above is a roller for heating the fixation belt 310. In other words, the halogen heater 340*a* heats the fixation belt 310 by heating the heat roller 340.

In this embodiment, from the standpoint of thermal conductivity, the heat roller 340 is formed of stainless pipe, which is 40 mm in external diameter, and 1 mm in thickness, for example. There may be only one halogen heater 340*a*. However, in consideration of the temperature distribution of the heat roller 340 in terms of its lengthwise direction (parallel to rotational axis), it is desired that the heat roller 340 is provided with two or more halogen heaters. In a case where the heat roller 340 is provided with two or more halogen heaters, they are made different in light distribution in terms of the lengthwise direction, so that they can be controlled in ON-ratio, according to recording medium size. In this embodiment, the heat roller 340 is provided with two halogen heaters 340*a*. By the way, the heat source for the heat roller 340 is not limited to a halogen heater. For example, it may be a carbon heater or the like as long as it is capable of heating the heat roller 340.

The fixation belt 310 is heated by the heat roller 340 which is heated by the halogen heater 340*a*. Its temperature is kept at a preset target level according to recording medium type, based on its temperature detected by a thermistor 390 as a temperature detecting means. Referring to FIG. 2, the thermistor 390 is placed in contact with, or in the adjacencies of, the peripheral surface of the heat roller 340. It detects the temperature of the heat roller 340.

The steering roller 350 is positioned on the inward side of the fixation belt 310 loop. It suspends and tensions the fixation belt 310, in coordination with the fixation pad 320 and heat roller 340. It is rotated by the fixation belt 310. The steering roller 350 controls the fixation belt 310 in the position (angular deviation) relative to its rotational axis, by being tilted relative to the rotational axis of the heat roller 340. That is, the fixing apparatus 8 is structured so that the steering roller 350 is pivotally movable about its center in terms of the direction parallel to its rotational axis. Thus, the steering roller 350 can be tilted relative to the lengthwise direction of the heat roller 340, about this center (pivot). As the steering roller 350 is tilted, one side of the fixation belt 310 in terms of the lengthwise direction becomes different in tension from the other side, causing therefore the fixation belt 310 to shift in the lengthwise direction.

The fixation belt 310 tends to move to one side or the other in terms of its widthwise direction, because of the nonuniformity in external diameter of the roller, by which the fixation belt 310 is suspended, and/or misalignment among the suspending-tensioning rollers. Therefore, the fixing apparatus 8 is structured so that it can be controlled in this type of lateral shifting of the fixation belt 310, by the steering roller 350. By the way, the steering roller 350 may be made to be pivotally moved by a driving force source such as a motor. Further, the fixing apparatus 8 may be structured so that the steering roller 350 will automatically pivot to align the fixation belt 310. Further, the pivot may be located at the center of the steering roller 350 as in this embodiment, or at one of the lengthwise ends of the steering roller 350.

Further, in the case of this embodiment, the steering roller 350 is under the pressure from a spring supported by the frame of the heating unit 300. That is, it functions also as a tension roller to provide the fixation belt 310 with a preset amount of tension. Because the fixation belt 310 is provided with tension by the steering roller 350 as described above, the fixation belt 310 is pressed upon the end portions 320*a* and 320*b* of the fixation pad 320. Thus, the fixation belt 310 is bent in the same shape as the end portions 320*a* and 320*b*.

The steering roller 350 is formed of a metallic substance such as aluminum and stainless steel. It is cylindrical. In this embodiment, the steering roller 350 is a piece of stainless steel, or aluminum, pipe, which is 40 mm in external diameter and 1 mm in thickness. It is rotatably supported by unshown bearings, by its lengthwise end portions. By the way, the steering roller 350 may be replaced with an ordinary suspending-tensioning roller, that is, a roller which does not have steering function.

The pressure roller 330 is a rotational member, and also, is a drive roller. It forms the above described nip between itself and fixation belt 310. While a sheet of recording medium having a toner image is conveyed through the nip while remaining pinched between the pressure roller 330 and fixation belt 310, the toner image on the sheet becomes fixed to the sheet. The pressure roller 330 described above rotates in contact with the outward surface of the fixation belt 310, causing the fixation belt 310 to rotationally move. In this embodiment, the pressure roller 330 comprises a central shaft (core), an elastic layer formed on the peripheral surface of the core, and an release layer formed on the peripheral surface of the elastic layer. The shaft is formed of stainless steel. The elastic layer is 5 mm in thickness. It is formed of electrically conductive silicone rubber. The release layer is 50 μm in thickness. It is formed of fluorine resin, more specifically, PPA (tetrafluoroethylene-perfluoroalkoxyethylene copolymer). The pressure roller 330 is rotatably supported by the frame 380 of the fixing apparatus 8. One end of the pressure roller 330 is fitted with a gear, which is in engagement with a motor M as a driving means, by which the pressure roller 330 is rotationally driven.

The frame 380 has a heat unit positioning portion 381, a pressure application frame 383, and pressure application springs 384. A stay 360 is inserted into the heat unit positioning portion 381. The stay 360 is fixed to the heat unit positioning portion 381 with an unshown fixing means, whereby the heating unit 300 is positioned relative to the frame 380. Here, the heat unit positioning portion 381 has a pressure direction regulating surface 381*a* which faces the pressure roller 330, and a conveyance direction regulating surface 381*b* which is a heating unit 300 accommodating surface. The stay 360 is attached to the frame 380 while being held immovable by the pressure direction regulating surface 381*a* and conveyance direction regulating surface 381*b*. During this operation, the pressure roller 330 is kept separated from the fixation belt 310.

After the heating unit 300 is fixed in position by the heat unit positioning portion 381, the pressure application frame 383 is moved by an unshown driving force source and a cam, whereby the pressure roller 330 is placed in contact with the fixation belt 310. Then, the pressure roller 330 is pressed against the fixation pad 320 with the presence of the fixation belt 310 between the pressure roller 330 and fixation pad 320. That is, in this embodiment, the pressure roller 330 is also a pressing member which is pressed toward the fixation belt 310. In this embodiment, the pressure applied during image formation is 1000 N.

Further, in the case of this embodiment, the fixing apparatus 8 is provided with a separating apparatus 400, which is on the downstream side of the nip N in terms of the recording medium conveyance direction. The separation apparatus 400 has a separating member 401 (separation plate) which separates recording medium from the fixation belt 310. The separating member 401 is positioned so that a gap is provided between itself and the outward surface of the fixation belt 310. It separates recording medium from the fixation belt 310 as the recording medium comes out of the nip N. More concretely, the separating member 401 is positioned near the portion of the outward surface of the fixation belt 310, which is between the fixation pad 320 and heat roller 340. Further, the separating member 401 is in the form of a blade. It is positioned so that one of its long edges faces the outward surface of the fixation belt 310. Further, the separating member 401 comprises a piece of metallic plate, and a piece of fluorinated tape pasted to the metallic plate to prevent the toner adhesion, and/or scarring of an image. In this embodiment, in order to position the separation member 401 in such a manner that a gap is provided between the separation member 401 and outward surface of the fixation belt 310, the separating member 401 is positioned relative to the stay 360 in terms of the recording medium conveyance direction (widthwise direction of stay 360; X direction).

The fixing apparatus 8 structured as described above heats the toner image on a sheet P of recording medium, in the nip N which is between the fixation belt 310 and pressure roller 330, by conveying the sheet P through the nip N while keeping the sheet P pinched between the fixation belt 310 and pressure roller 330. Thus, the toner is melted, and becomes fixed to the sheet P as it cools. In the case of this embodiment, the peripheral velocity of the fixation belt 310 during image formation is 300 mm/s. The nip pressure is 1,000 N during image formation. Further, the temperature of the fixation belt 310 during image formation is 180° C.

[Control Portion]

Figure 4:
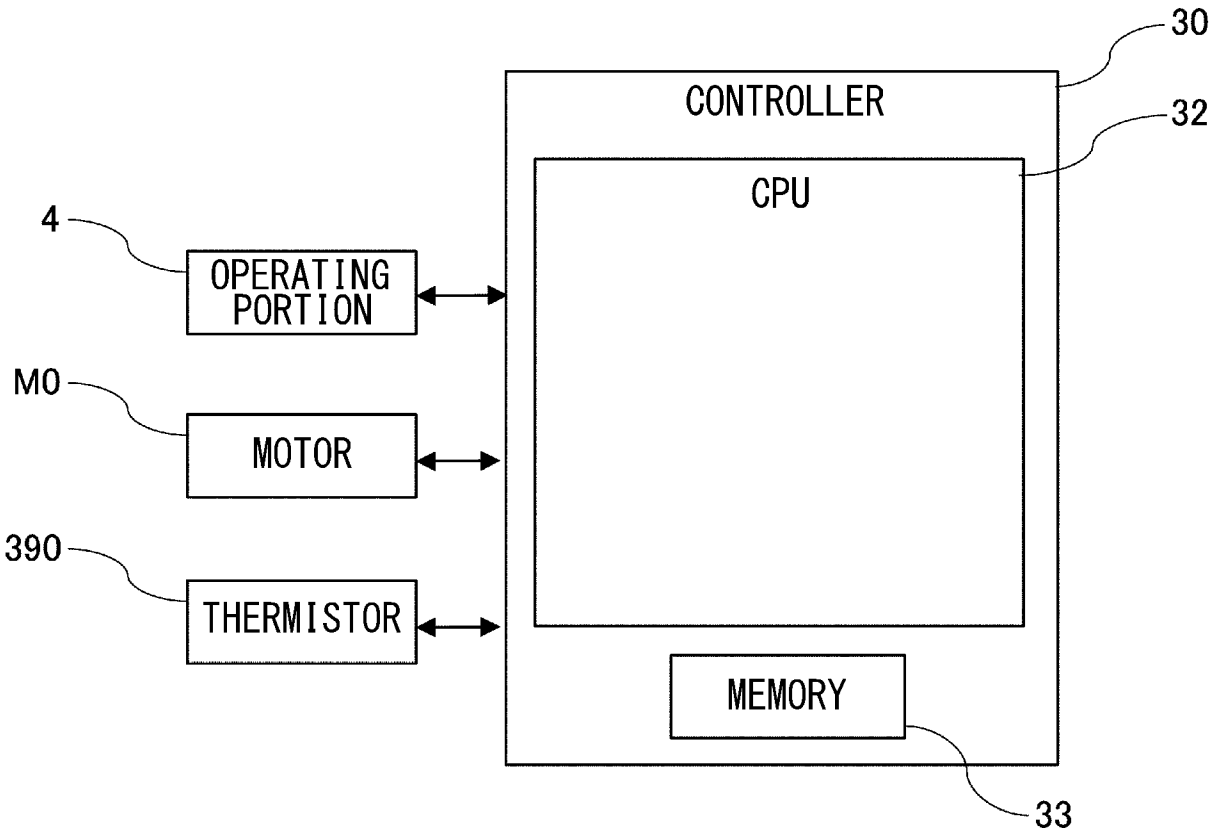
FIG. 4 is a block diagram which shows the relationship among the control portion, control panel, motor, thermistor, and memory of the image forming apparatus in the first embodiment.

Next, referring to FIG. 4, the control portion 30 of the image forming apparatus 1 is described about its control over the fixing apparatus 8. The control portion 30 has a CPU 32 (Central Processing Unit), and memories 33 such as a ROM (Read Only Memory) and a RAM (Random Access Memory).

The CPU 32 obtains various data inputted through its control panel 4, and stores the data in the memories 33. The control panel 4 is a part of the image forming apparatus 1. It is in the form of a touch panel or a button, for example, which makes it possible for the image forming apparatus 1 to be operable by touch.

Further, the CPU 32 is capable of reading printing (image formation) programs from the memories 32, in response to such an operation as turning on the power source of the image forming apparatus 1, carried out by a user, and carries out the programs.

The memories 33 holds various programs such as printing programs and image formation job, and various data. By the way, the memories 33 can temporarily store the results of the computations to carry out various programs.

In the case of this embodiment, the CPU 32 controls the image forming apparatus 1 in operations related to the printing of an image on recording medium, by carrying out printing programs. By the way, not all the printing programs are in the form of software. For example, they may be in the form of micro-programs processable by a DSP (digital signal processor). Thus, the image forming apparatus 1 may employ such processes as the above described one, in addition to the CPU 32, to carry out various operations such as image forming operation, by carrying out control programs for an image formation job. However, a processor dedicated to carry out printing programs may be exclusively employed.

Further, the CPU 32 controls a halogen heater 340*a*, based on the temperature detected by the thermistor 390, and also, controls a motor M0 which drives the pressure roller 330. The control of the motor M0, based on the temperature detected by the thermistor 390 will be described later.

[Temperature Distribution of Fixation Belt in Terms of Direction of Fixation Belt Rotation]

Figure 5:
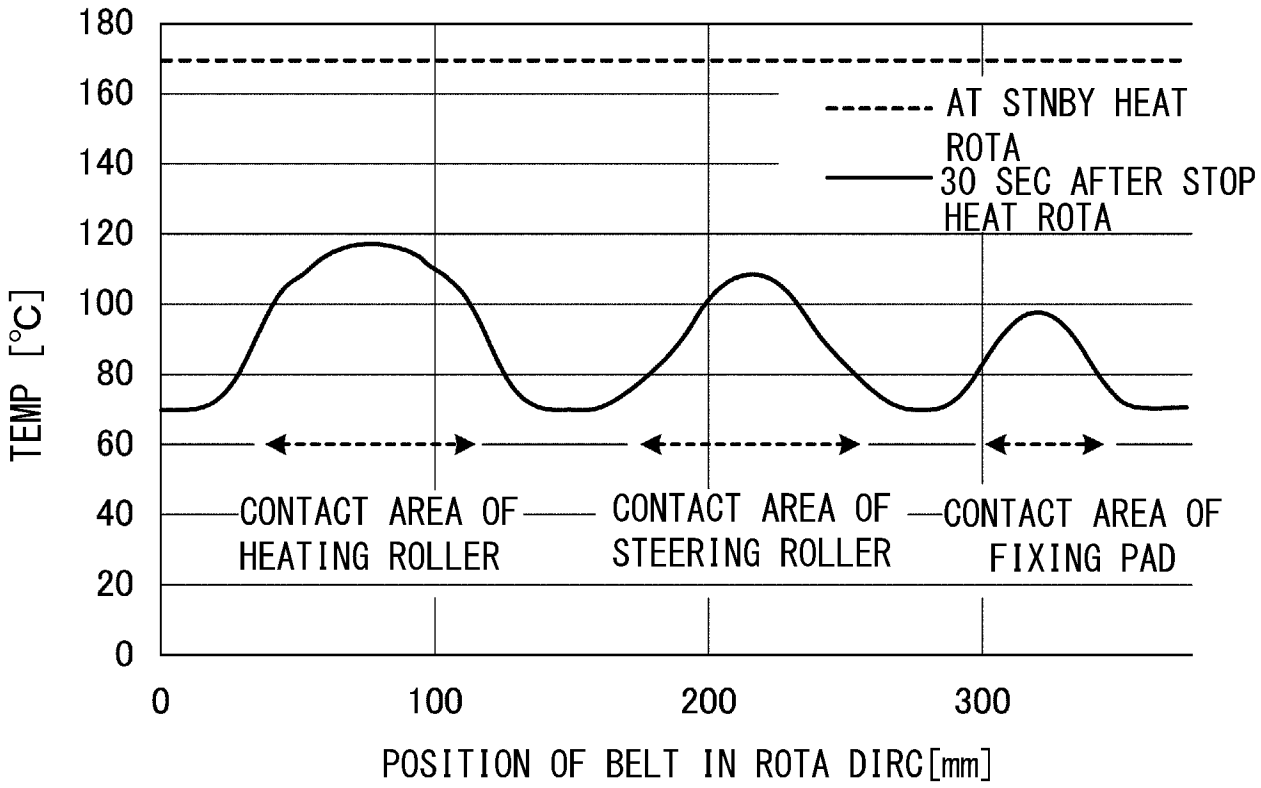
FIG. 5 is a graph which shows the temperature distribution of the fixation belt in terms of the rotational direction of the fixation belt.

Here, in a case where the fixing apparatus 8 is structured so that the fixation belt 310 is locally heated by the heat roller 340, that is, only at a specific point in terms of the rotational direction of the fixation belt 310, as described above, it is possible that the portion of the fixation belt 310, which is at the point of heating, and the portion of the fixation belt 310, which is not at the point of heating, will become different in temperature. This issue is described with reference to FIGS. 5-8. FIG. 5 shows the temperature distribution of the fixation belt 310 in terms of the rotational direction of the fixation belt 310 during a standby-rotation-heating period, and a post-heating-rotation period.

"The standby-heating-rotation period" means a period in which the fixing apparatus 8 is on standby; the fixation belt 310 is rotated; and the fixation belt 310 is heated, and that immediately after the heating and rotation of the fixation belt 310 was stopped. "The image forming apparatus 1 is on standby" means that the image forming apparatus 1 is in a state in which it is lower in electric power consumption than during an operation for forming a toner image on recording medium. In this embodiment, when the image forming apparatus 1 is on standby, the heat roller 340 is kept lower in electric power consumption than during an ordinary image forming operation. For example, when the image forming apparatus 1 is kept on standby, the heat roller 340 is controlled in temperature so that its temperature remains at 180° C. Further, the post-heating-rotation period means 30 seconds after the stopping of the rotation of the fixation belt 310, and the stopping of heating by the heat roller 340, while the fixing apparatus 8 is on standby.

The horizontal axis in FIG. 5 represents the position of a given point of the fixation belt 310 from the midpoint between the heat roller 340 and fixation pad 320. The clockwise direction in FIG. 2 is the positive direction. Referring to the broken line in FIG. 5, during the standby-heating-rotation period, the heat roller 340 is controlled in temperature so that its temperature remains at 180° C., and the fixation belt 310 remains uniform in temperature distribution at roughly 170° C., in terms of its rotational direction.

On the other hand, referring to the solid line in FIG. 5, the fixation belt 310 begins to reduce in temperature due to radiation 30 seconds after the stopping of heating and rotation, because heating was stopped. However, it takes time for the portions of the fixation belt 310, which are in contact with the heat roller 340, steering roller 350, and fixation pad 320, to reduce in temperature after the stopping of the heating and rotation, because heat was stored in these rollers and pad during the heating-rotating period. On the contrary, the portions of the fixation belt 310, which are not in contact with any of the suspending-tensioning members, quickly reduce in temperature, because the fixation belt 310 itself is thin.

As described above, the fixation belt 310 is nonuniform in terms of its rotational direction in the speed at which it reduces in temperature. That is, in terms of the rotational direction of the fixation belt 310, the portions of the fixation belt 310, which are in contact with the suspending-tensioning members, which are in the form of a roller, and a pad, become different in temperature from the portions of the fixation belt 310, which are not in contact with the suspending-tensioning members. As a result, the fixation belt 310 becomes nonuniform in the amount of thermal expansion. Consequently, the fixation belt 310 becomes distorted. In particular, in a case where the heat roller 340, steering roller 350, and fixation pad 320 are substantial in thermal capacity compared to the fixation belt 310, it is more likely for the abovementioned nonuniformity in the temperature of the fixation belt 310 to reach a harmful level.

Figure 6:
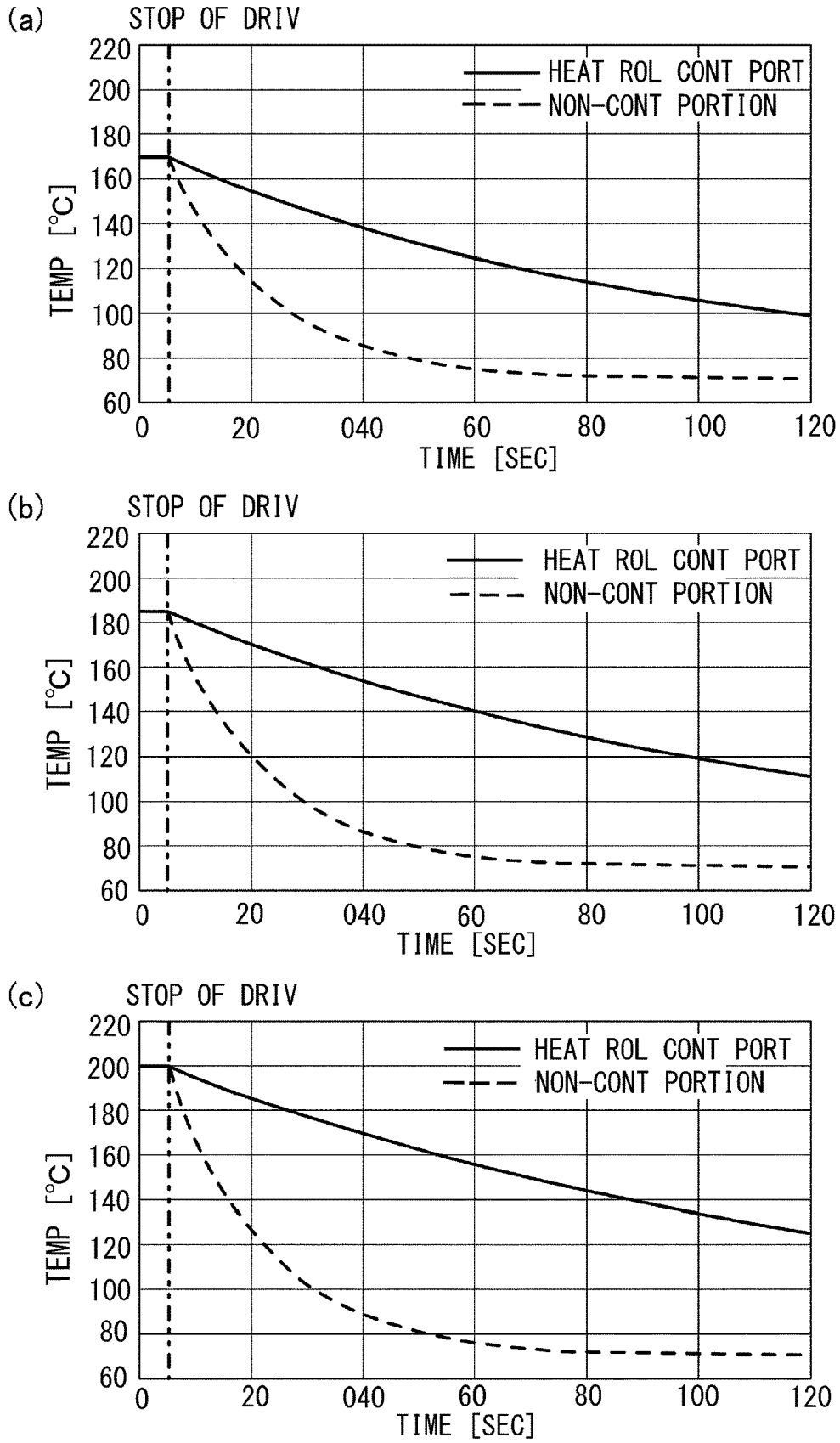
FIG. 6, parts (a), (b), and (c), is a graph which shows the changes which occurred to the temperature of the heat roller after the fixation belt was stopped when the temperature of the fixation was (a) 170° C., (b) 185° C. and (c) 200° C.

FIGS. 6(*a*)-(*c*) show the changes which occurred to the temperature of the fixation belt 310 after the rotational driving of the fixation belt 310 was stopped. FIG. 6(*a*) shows the changes in a case where the temperature of the fixation belt 310 was 170° C. at the time when the fixation belt 310 was stopped; FIG. 6(*b*), 185° C.; and FIG. 6(*c*) shows the changes in a case where the temperature of the fixation belt 310 was 200° C. 170° C. is a temperature setting for standby period; 185° C., for the normal printing operation (image forming period); 200° C. is the temperature setting for cardstock (300 gsm (g/m$^2$) in basis weight).

The horizontal axis represents elapsed time. At 5 seconds, the fixation belt 310 is stationary. The temperature (solid line) of the portions of the fixation belt 310, which are in contact with at the heat roller 340, was measured from the outward side of the fixation belt 310, at the center of the portions of the fixation belt 310, which were in contact with the heat roller 340, in terms of the rotational direction of the fixation belt 310, with the use of a non-contact radiation thermometer. The temperature (broken line) of the portion of the fixation belt 310, which was not in contact with the aforementioned suspending-tensioning rollers and pad, was measured from the outward side of the fixation belt 310 at the midpoint between the heat roller 340 and steering roller 350.

Here, the greater the amount of the heat stored in the heat roller 340, the less likely it was for the portion of the fixation belt 310, which was in contact with the heat roller 340, to reduce in temperature. That is, the higher is the heat roller 340 in temperature when the fixation belt 310 is stopped, the more slowly the fixation belt 310 reduces in temperature. On the other hand, when the fixation belt 310 was remaining stationary, the portions of the fixation belt 310, which were not in contact with the aforementioned rollers and pad, was small in the amount by which they were affected by the temperature of the heat roller 340. It showed roughly the same in the amount of reduction in temperature. Thus, the maximum amount of nonuniformity in the temperature of the fixation belt 310 in terms of its rotational direction was 53° C. in FIG. 6(*a*); 67° C., in FIG. 6(*b*); and 82° C. in FIG. 6(*c*). Thus, it became evident that the higher the heat roller 340 is in temperature when the rotation of the fixation belt 310 is stopped, the greater is the fixation belt 310 in the amount of nonuniformity in temperature in terms of its rotational direction.

Figure 7:
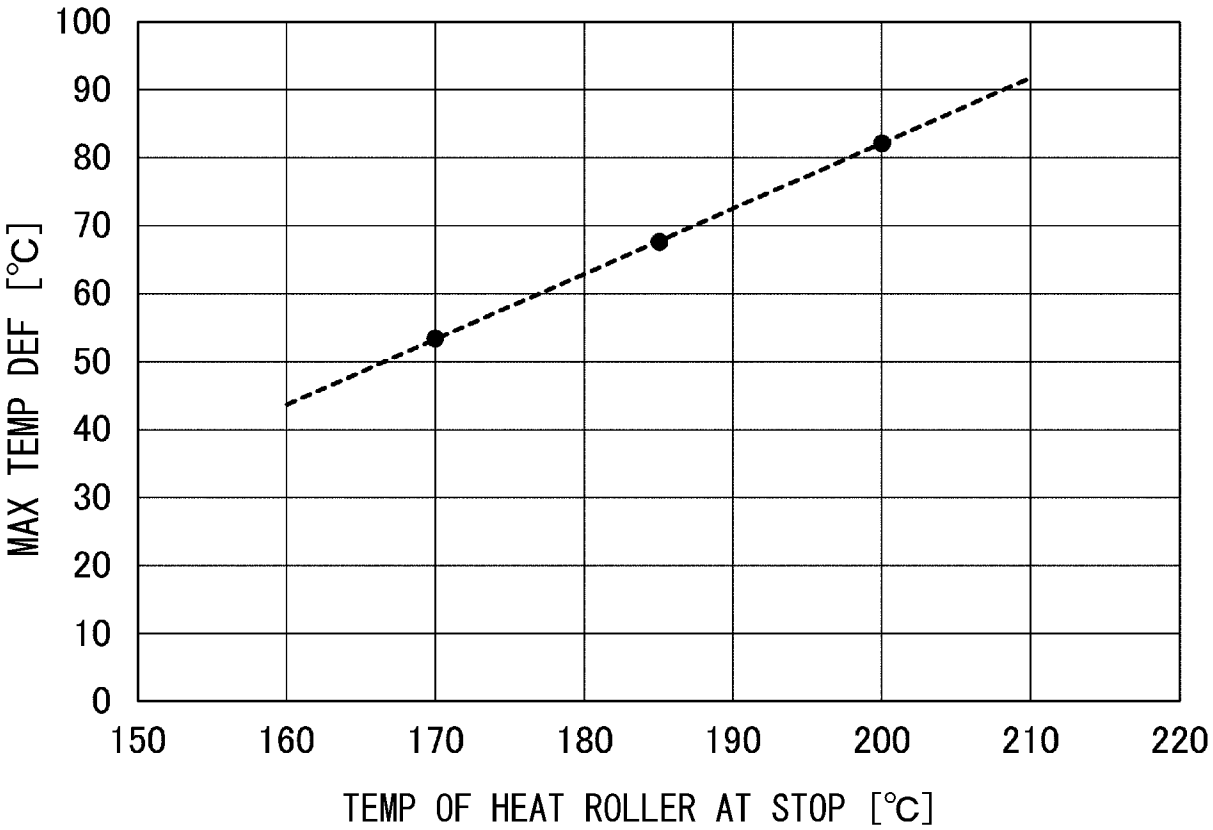
FIG. 7 is a graph which shows the relationship between the heat roller temperature at the time of the stopping of the fixation belt, and the maximum amount of nonuniformity in the fixation belt temperature in terms of the direction of belt rotation.

Shown in FIG. 7 is the relationship between the temperature of the heat roller 340 when the rotation of the fixation belt 310 was stopped, and the maximum amount of nonuniformity in temperature of the fixation belt 310 in terms of its rotational direction. Further, shown in FIG. 8 are the maximum amount of nonuniformity in the temperature of the fixation belt 310 in its rotational direction, and the result of the experiment carried out to determine whether or not the fixation belt 310 buckled. "o" indicates that the buckling did not occur. "x" indicates that the buckling occurred. Whether or not the fixation belt 310 buckled was visually determined. It became evident from the result of these experiments that as long as the amount of nonuniformity of the fixation belt 310 in temperature in terms of the rotational direction is no more than 80° C., the fixation belt 310 does not buckle, but it buckles at 90° C. Next, referring to FIG. 7, it became evident that if it is wanted to make the maximum amount of nonuniformity in temperature of the fixation belt 310 in terms of the rotational direction of the fixation belt 310 no more than 80° C., below which the fixation belt 310 does not buckle, the heat roller 340 has to be no more than 200° C., preferably, 85° C., in temperature when the rotation of the fixation belt 310 is stopped.

[Control to be Executed Right after Stopping of Rotation of Fixation Belt]

As described above, as the rotation of the fixation belt 310 is stopped, the fixation belt 310 becomes nonuniform in temperature in terms of its rotational direction. The higher the fixation belt 310 in temperature at the moment when the rotation of the fixation belt 310 is stopped, the greater is the amount of nonuniformity in temperature of the fixation belt 310 in its rotational direction. As the fixation belt 310 becomes nonuniform in temperature in terms of its rotational direction as described above, distortion occurs to the fixation belt 310. Moreover, if the amount of distortion exceeds the yield stress of the fixation belt 310, the fixation belt 310 may buckles.

In this embodiment, therefore, in a case where the temperature detected by the thermistor 390 right after the stopping of the rotation of fixation belt 310 is higher than a preset value, the CPU 32 (FIG. 4), as a controlling means, continues the rotation of the fixation belt 310. Here, "right after the stopping of the rotation of the fixation belt 310" means "as the CPU 32 receives a command to stop the rotation of the fixation belt 310". More concretely, it means right after the electrical power source of the apparatus is turned on or off, and the apparatus is put in the sleep mode. As examples of command which the CPU 32 receives to stop the rotation of the fixation belt 310, there are a command which the CPU 32 receives when the electric power source is turned off by the operation of a button, a command to put the apparatus in the sleep mode, etc., In this embodiment, the image forming apparatus 1 is structured so that when the image forming apparatus 1 is kept in the standby mode in which the image forming apparatus 1 is capable of starting image formation, the rotation of the fixation belt 310 is continued. However, when the electric power source is off, and when the image forming apparatus 1 is in the sleep mode, the fixation belt 310 is kept stationary.

The sleep mode is such a mode that the image forming apparatus 1 is lower in electric power consumption than when it is kept on standby. For example, in a case where the fixing apparatus 8 is on standby, and is not in operation for a preset length of time, or a print signal is not received for a preset length of time, the fixing apparatus 8 is changed in the state of operation from "standby" to "sleep". However, it is possible for an operator to put the fixing apparatus 8 to sleep.

Figure 9:
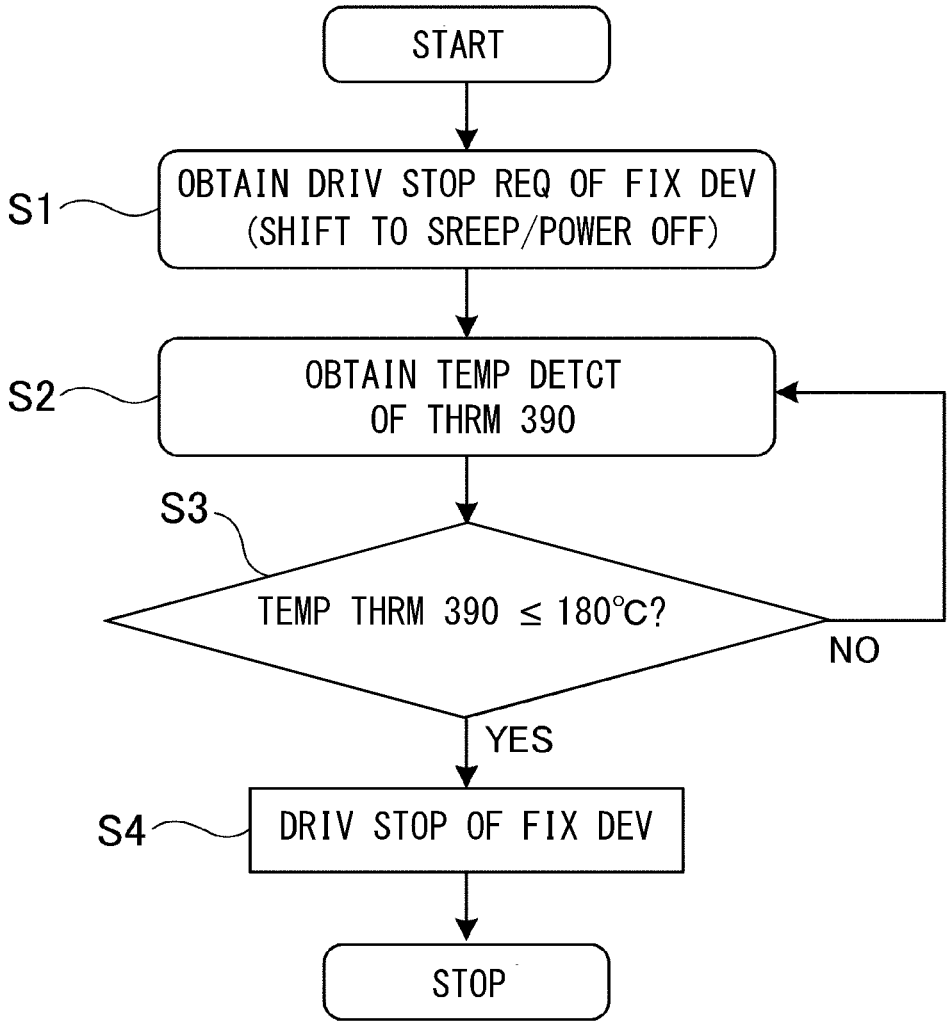
FIG. 9 is a flowchart of the control sequence, which is carried out as the driving of the fixation apparatus in the first embodiment is stopped.

Next, referring to FIG. 9, the control sequence which is carried out as the driving of the fixation belt 310 is stopped is described. As the CPU 32 receives a command to stop the driving of the fixing apparatus 8 (command to turn off electric power source, or put fixing apparatus 8 to sleep), that is, a command to stop the rotation of the fixation belt 310 (S1), it obtains the results of the temperature detection by the thermistor 390 (S2). "To obtain a command to stop the driving of the fixing apparatus 8" means that the CPU 32 receives a signal to put the fixing apparatus 8 to sleep, or a signal to turn off the electric power source.

The CPU 32 determines whether or not the result detected in S2 is no higher than a preset value, more specifically, 185° C. (S3). If the detected temperature is the preset one, that is, 180° C. (NO in S3), the CPU 32 goes back to S2, continues the rotation of the fixation belt 310, and obtains again the result of the temperature detection by the thermistor 390. By the way, during this portion of the operational sequence, the pressure roller 330 may be kept in contact with, or separated from, the fixation belt 310. In a case where it is wanted to keep the pressure roller 330 separated from the fixation belt 310, the pressure roller 330 may be separated as the CPU 32 obtains the command to stop the driving of the fixing apparatus 8.

On the other hand, in a case where the temperature detected in S2 is no more than the preset value, that is, 180° C. (YES in S3), the CPU 32 stops the driving of the fixing apparatus 8. That is, it stops the rotation of the fixation belt 310 (S4). By the way, in a case where the pressure roller 330 is in contact with the fixation belt 310, the pressure roller 330 should be kept separated from the fixation belt 310 at least while the fixation belt 310 is kept stationary. To reiterate, as the CPU 32 receives the command to stop the rotation of the fixation belt 310, it determines whether or not the temperature detected by the thermistor 390 is higher than the preset value. If the detected temperature is higher than the preset value, the CPU 32 continues the rotation of the fixation belt 310 until the detected temperature falls below the preset value. By the way, in this embodiment, the preset temperature value is 180° C. However, it may be set to 200° C. or higher. That is, the image forming apparatus 1 (fixing apparatus 8) may be designed so that if the temperature detected at the time of the stopping of the rotation of the fixation belt 310 is no less than 200° C., the rotation of the fixation belt 310 is continued until the detected temperature falls below the preset one, but if it is no more than 200° C., the rotation of the fixation belt 310 is stopped.

Next, referring to FIGS. 10-13, which are timing charts, an example of control of the fixation belt is described. Hereinafter, it is assumed that the image forming apparatus 1 carries out a printing operation (image forming operation), an operation to end a printing operation, an operation to be put to sleep, an operation to be awakened, and an operation to restart printing operation, in the listed order. By the way, a printing operation is an operation to form an image in response to a print signal. As the image forming apparatus 1 completes a printing operation, it starts a standby operation. If the image forming apparatus 1 is kept on standby for a preset length of time, it is put to sleep. Then, as a print signal is inputted, the image forming apparatus 1 is awakened (recovery from sleep). Then, the image forming apparatus 1 starts a printing operation.

The motor M0, which is a driving means, can drive the fixation belt 310 at the first speed, and the second speed which is faster than the first one. It is assumed here that the first speed is the printing speed (which in this embodiment is 300 mm/s). That is, during an image forming operation, the CPU 32 drives the fixation belt 310 at the first speed. Further, it is assumed here that the second speed is the standby speed (which in this embodiment is 50 mm/s). That is, as an image forming operation ends, and the image forming apparatus 1 is put on standby, the CPU 32 switches the image forming apparatus 1 in operation speed from the first speed to the second one.

Figure 10:
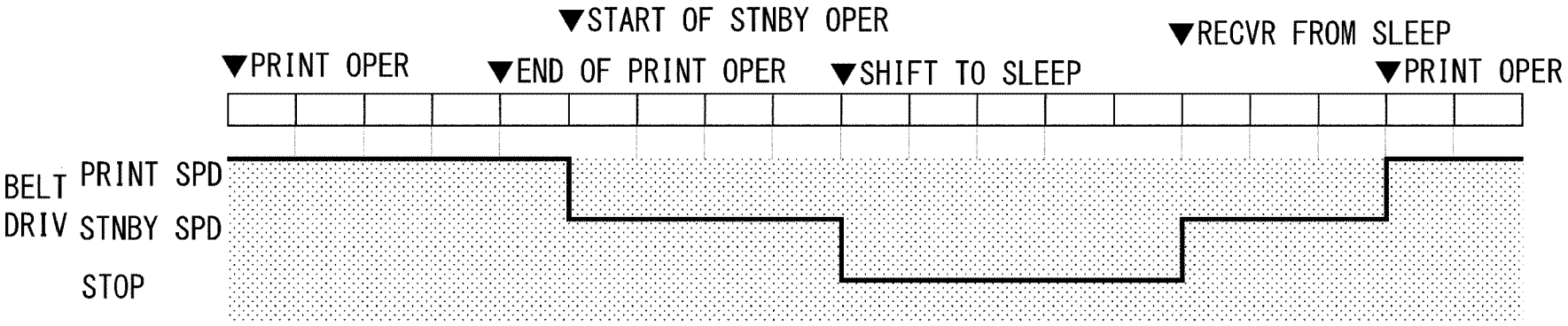
FIG. 10 is a timing chart for the comparative driving of fixation belt.
Figure 11:
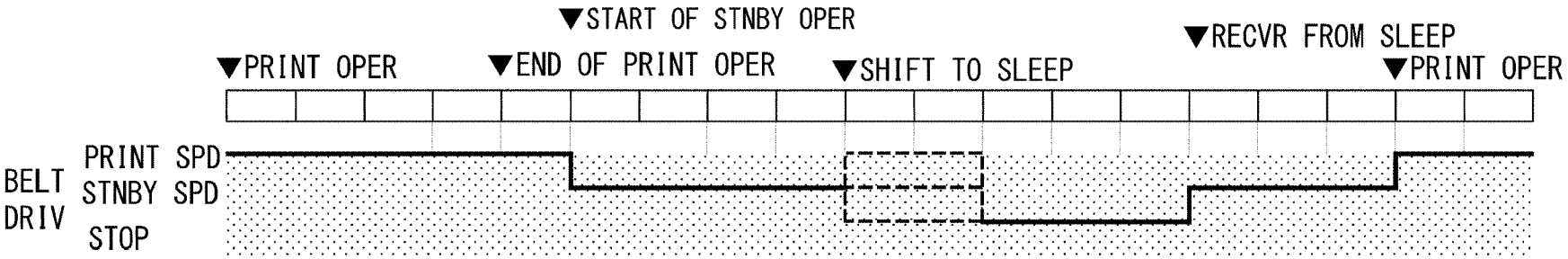
FIG. 11 is a timing chart for the first example of driving of the fixation belt in the first embodiment.
Figure 12:
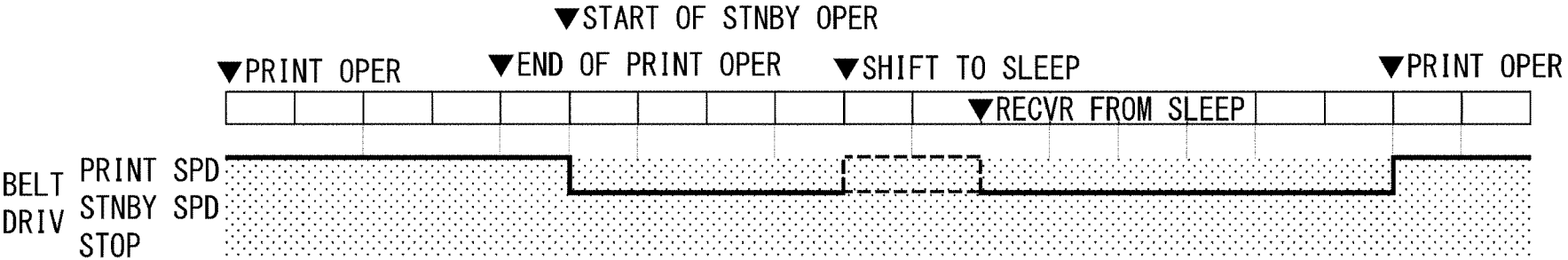
FIG. 12 is a timing chart for the second example of driving of the fixation belt in the first embodiment.
Figure 13:
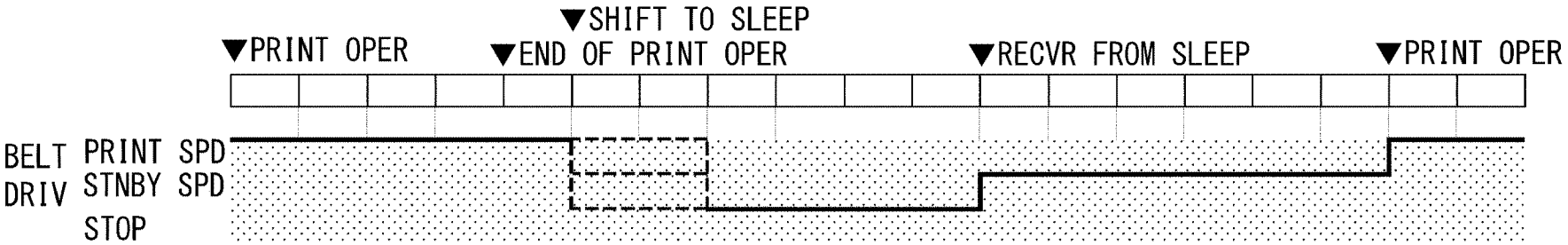
FIG. 13 is a timing chart for the third example of driving of the fixation belt in the first embodiment.

FIG. 10 represents an example of comparative control of the fixing apparatus. FIG. 11 represents the first embodiment of the present invention. FIG. 12 represents the second embodiment of the present invention. FIG. 13 represents the third embodiment of the present invention. In the case of the example of comparative control of a fixing apparatus, before the image forming apparatus 1 is put to sleep, the rotation of the fixation belt 310 is stopped regardless of the temperature detected by the thermistor 390. Otherwise, it is the same as this embodiment.

To begin with, in the case of the comparative control of a fixing apparatus, shown in FIG. 10, after the ending of a printing operation, the CPU 32 changes the fixing apparatus 8 in the speed with which it drives the fixation belt 310, from the printing speed (which is 300 mm/s in this embodiment) to the standby speed (which is 50 mm in this embodiment. Then, as the CPU 32 receives a signal to put the image forming apparatus 1 to sleep it stops the driving of the fixation belt 310.

Next, in the first embodiment of the present invention represented by FIG. 10, as the CPU 32 receives a signal to put the fixing apparatus to sleep, it determines, based on the result of temperature detection by the thermistor 390, whether or not the driving of the fixation belt 310 is to be continued. In a case where the rotation of the fixation belt 310 is to be continued, the speed at which the fixation belt 310 is to be driven may be the same as the printing speed, or standby speed. That is, among the three broken lines, the top and middle ones indicate that the temperature detected by the thermistor 390 is higher than the preset value, and the rotation of the fixation belt 310 is being continued. Further, the top broken line represents a case in which the fixation belt 310 is being rotated at the printing speed. The middle broken line represents a case in which the fixation belt 310 is being driven at the standby speed. The bottom broken line represents a case in which the temperature detected by the thermistor 390 is no more than the preset value, and the fixation belt 310 is kept stationary. In a case where the rotation of the fixation belt 310 is being continued, if the temperature detected by the thermistor 390 begins to satisfy a preset condition, that is, the detected temperature falls below the preset value, the driving of the fixation belt 310 is stopped. In this embodiment, as the detected temperature falls below the preset value, the driving of the fixation belt 310 is stopped. That is, the image forming apparatus 1 may be structured so that the rotation of the fixation belt 310 is stopped after the elapse of a preset length of time after the detected temperature falls below the preset value. This embodiment is the same in the structure to turn off the electric power source.

Next, the second embodiment of the present invention represented by FIG. 12 is related to a case where a signal for making the image forming apparatus 1 recover from sleep is received while the driving of the fixation belt 310 is being continued based on the temperature detected by the thermistor 390. In this case, the fixing apparatus 8 is put on standby without stopping of the driving of the fixation belt 310, that is, the driving of the fixation belt 310 is continued. In this case, the speed at which the fixation belt 310 is driven may be the printing speed, or standby speed (broken line portions). That is, even if the CPU 32 receives a command to start the rotation of the fixation belt 310 while it is continuing the rotation of the fixation belt 310 even though it received a command to stop the rotation of the fixation belt 310, it continues the rotation of the fixation belt 310. In this case, even if the temperature detected by the thermistor 390 falls below the preset value, the CPU 32 continues the rotation of the fixation belt 310, without stopping the rotation of the fixation belt 310.

The third embodiment of the present invention represented by FIG. 13 is related to a case in which the CPU 32 receives a signal to put the fixing apparatus 8 to sleep, while the fixation belt 310 is being driven at the printing speed. Also in this case, the CPU 32 determines, based on the result of temperature detection by the thermistor 390, whether or not the driving of the fixation belt 310 is to be continued. In a case where the CPU 32 continues the rotation of the fixation belt 310 like in the case represented by FIG. 11, the speed at which the fixation belt 310 is driven may be the printing speed, or standby speed (broken lines).

As described above, in this embodiment, in a case where the temperature detected by the thermistor 390 at the time of the stopping of the fixation belt 310 is higher than the preset value, the CPU 32 continues the rotation of the fixation belt 310. Thus, it is possible to prevent the problem that the fixation belt 310 is made to partially distort, by its nonuniform thermal expansion attributable to the nonuniformity, in temperature, of the fixation belt 310 in terms of its rotational direction. Therefore, it is possible to prevent the fixation belt 310 from buckling, making it possible to prevent the formation of unsatisfactory images.

By the way, in this embodiment, the temperature of the heat roller 340 was detected by the thermistor 390, and the image forming apparatus 1 (fixing apparatus 8) was controlled based on this detected temperature. However, the above described control may be executed based on the temperature of the part of the outward surface of the fixation belt 310 which is in contact with the heat roller 340. However, instead of the temperature of the portion of the fixation belt 310, which is contact with the heat roller 340, the temperature of the heat roller 340 itself, or the temperature of the portion of the outward surface of the fixation belt 310 which is in contact with the heat roller 340, may be used. "Part of the outward surface of the fixation belt 310 which is in contact with the heat roller 340" means the part of the outward surface of the portion of the fixation belt 310 which is between the upstream and downstream ends of the portion of the fixation belt 310, in terms of the rotational direction of the fixation belt 310, which is in contact with the heat roller 340. In such a case, the thermistor 390 is placed in contact with, or in the adjacencies of, the portion of the outward surface of the fixation belt 310, which is in the abovementioned range.

Further, in this embodiment, the fixing member, with which the unfixed toner image on recording medium comes into contact, was a belt. However, the above described control may also be applied to an fixing apparatus structured so that its pressing member which forms a nip between itself and the fixing member of the fixing apparatus, and also, a fixing apparatus, both the fixing member and pressing member of which are in the form of a belt.

Embodiment 2

Figure 14:
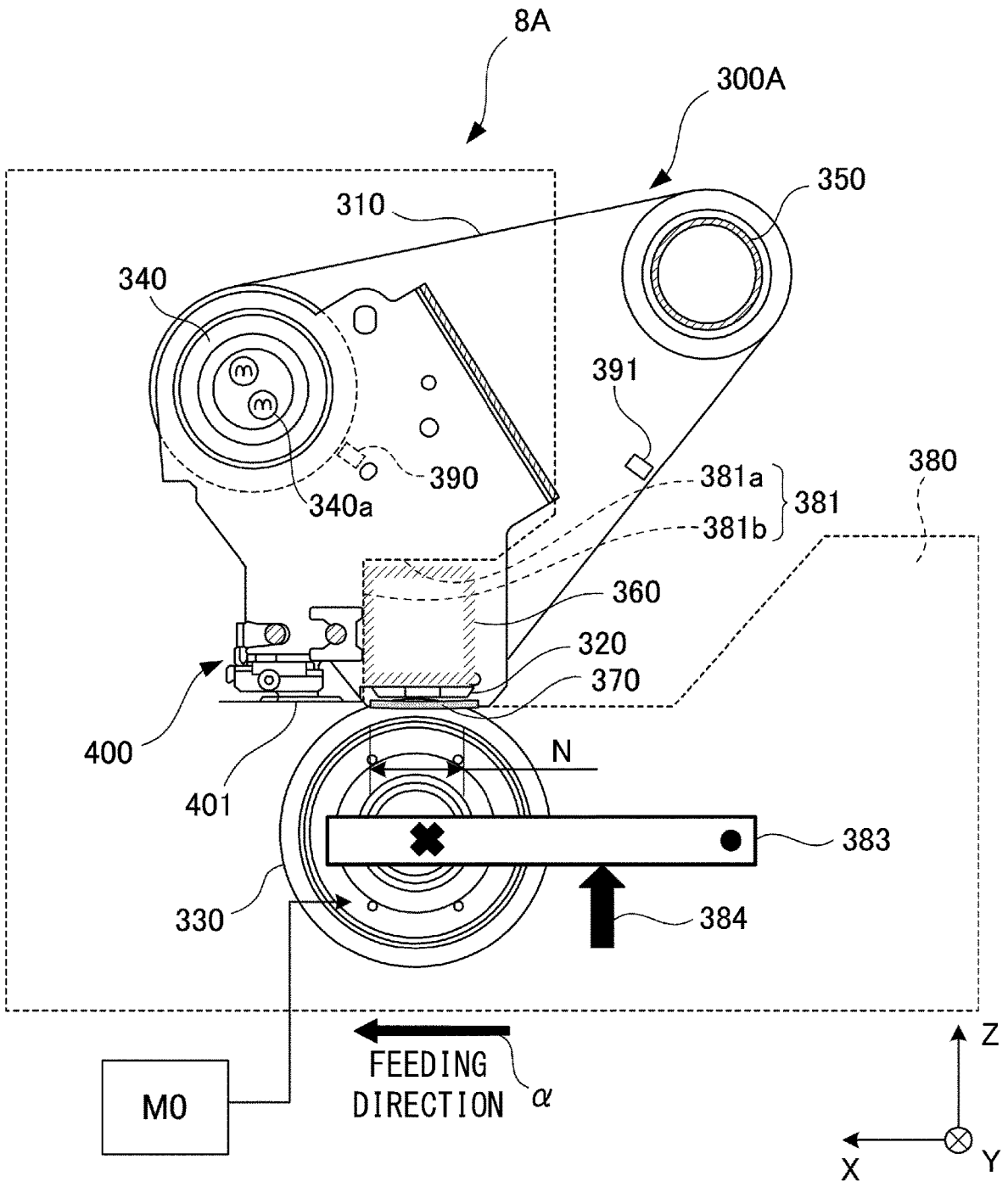
FIG. 14 is a schematic sectional view of the fixing apparatus in the second embodiment of the present invention; it shows the general structure of the apparatus.
Figure 15:
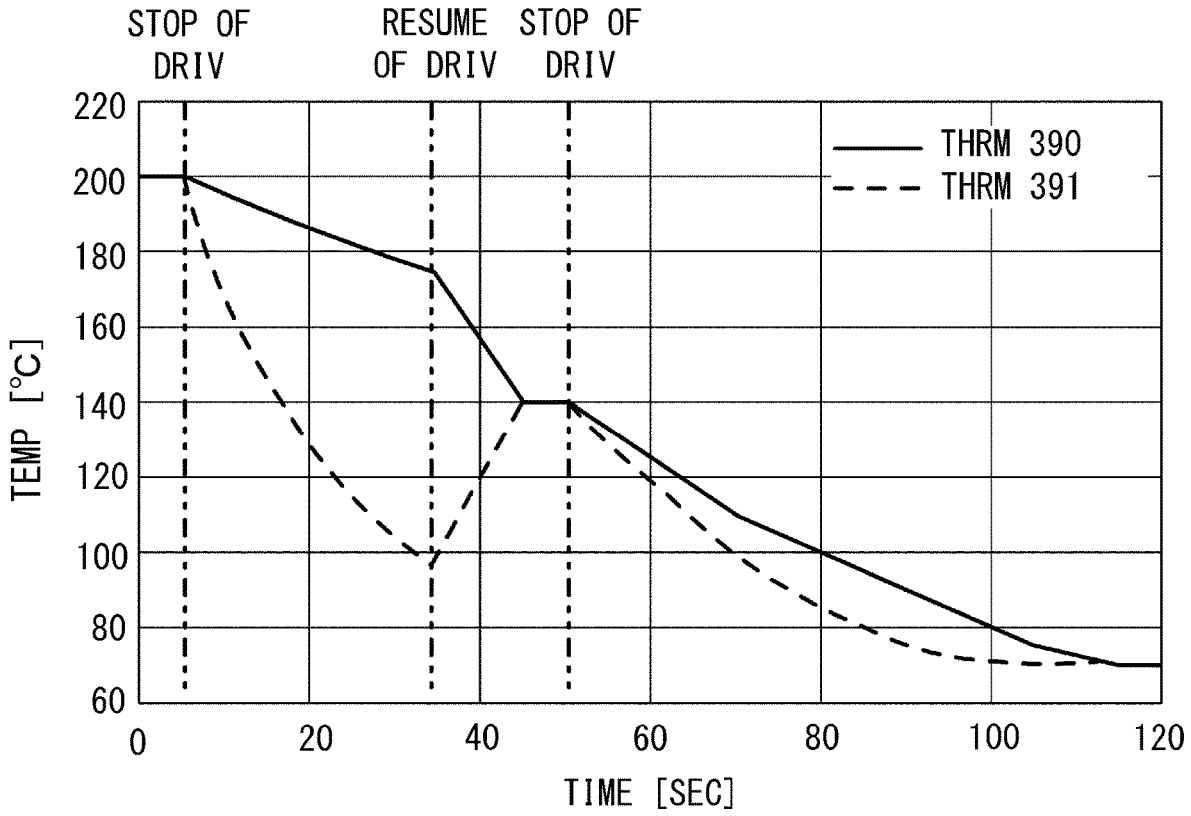
FIG. 15 is a graph which shows the changes which occurred to the difference in temperature between the two thermistors, after the stopping of the driving of the fixing apparatus in the second embodiment.
Figure 16:
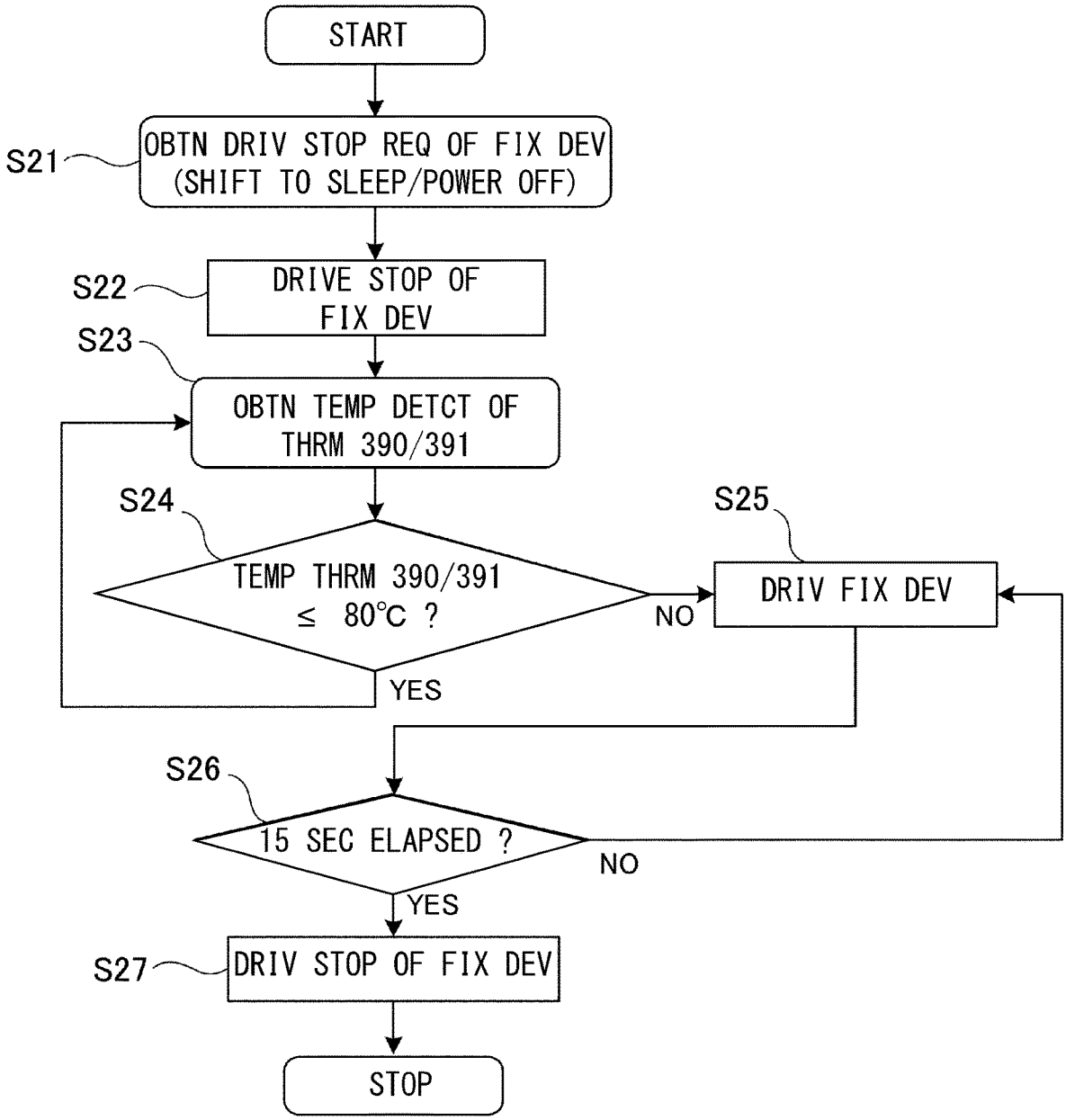
FIG. 16 is a flowchart of the control sequence which is carried out while the driving of the fixing apparatus in the second embodiment is stopped.

Next, referring to FIGS. 14-16, the second embodiment of the present invention is described. In the first embodiment described above, the temperature of the heat roller 340 is detected by the thermistor 390, and whether or not the rotation of the fixation belt 310 is to be continued was determined based on this detected temperature. In comparison, in this embodiment, the temperature of the heat roller 340 is detected by the thermistor 390, and the temperature of the portion of the fixation belt 310, which is not in contact with a suspending-tensioning roller, is detected by a thermistor 391. Then, whether or not the driving of the fixation belt 310 is continued is determined based on the difference between the detected two temperatures. The structure and function of the fixing apparatus 8 in this embodiment are the same as the counterparts in the first embodiment. Therefore, the structural components of the fixing apparatus (image forming apparatus) in this embodiment, which are the same in structure are given the same referential codes as the counterparts in the first embodiment to simplify their description and drawings. Next, the second embodiment is described about its difference from the first embodiment.

In the first embodiment, whether or not the driving of the fixation belt 310 is to be continued was determined based on the result of temperature detection by the thermistor 390 positioned to detect the temperature of the heat roller 340. However, the amount of nonuniformity of the fixation belt 310 in temperature in terms of the rotational direction of the fixation belt 310 is affected by the length of time which elapses while the fixation belt 310 remains stationary. Therefore, in some cases, it is unnecessary to stop the rotation of the fixation belt 310, although it depends on the timing with which the next driving of the fixation belt 310 is to be started.

The fixing apparatus 8A of the heating unit 300A in this embodiment is equipped with two thermistors 390 and 391. The thermistor 390, which is the first temperature detecting means detects the temperature of the heat roller 340 as one of the suspending-tensioning members. The thermistor 391, which is the temperature detecting second member, detects the temperature of the portions of the fixation belt 310, which are not in contact with any of the multiple suspending-tensioning members, that is, the heat roller 340 and steering roller 350.

More concretely, the thermistor 391 is positioned in contact with, or in the adjacencies of, the inward surface of the portion of the fixation belt 310 which is between the steering roller 350 and fixation pad 320 and is not in contact with the steering roller 350 and fixation pad 320. Further, in this embodiment, the thermistor 390 is positioned in contact with, or in the adjacencies of, the portion of the fixation belt 310, which is not in contact with any of the suspending-tensioning members as described above, to detect the nonuniformity, in temperature, of the fixation belt 310 in terms of the rotational direction of the fixation belt 310 after the stopping of the rotation of the fixation belt 310. Further, if the amount of this nonuniformity becomes greater than a preset value, the driving of the fixation belt 310 is restarted. The preset value is 80° C., for example.

FIG. 15 shows the chronological changes which occurred to the temperature of the fixation belt 310 detected by the thermistors 390 and 391, with elapse of time after the CPU 32 received a command to stop the rotation of the fixation belt 310 and stopped the driving of the fixation belt 310. At the time of stopping of the driving of the fixation belt 310, the temperature of the heat roller 340 was 200° C. The amount of difference between the temperature detected by the thermistor 390 and that by the thermistor 391 at the time when the driving of the fixation belt 310 was stopped was obtained. If the amount of difference exceeds a preset value, the driving of the fixation belt 310 is restarted, and stopped after the elapse of a preset length of time. The preset length of time is seconds, for example. In the case shown in FIG. 15, the driving of the fixation belt 310 was restarted 30 seconds after the stopping of driving of fixation belt 310, and then, was stopped after the elapse of 15 seconds. That is, the operation to reduce the fixation belt 310 in the amount of nonuniformity in temperature was carried out only when necessary. Thus, this embodiment can increase a fixing apparatus (fixation belt) in life expectancy, by preventing the fixation belt 310 from being unnecessarily driven.

Next, referring to FIG. 16, the control sequence which is to be carried out by the CPU 32 after the reception of a command to stop driving the fixing apparatus 8A is described. First, as the CPU 32 (FIG. 4) receives a command to stop the driving of the fixing apparatus 8A, that is, the rotation of the fixation belt 310 (S21), it stops driving the fixing apparatus 8A, that is, the rotation of the fixation belt 310 (S22). "The CPU 32 receives a command to stop driving the fixing apparatus 8A" means that the CPU 32 receives a signal to put the fixing apparatus 8A to sleep, or turn off the electrical power source. Next, the CPU 32 obtains the result of the temperature detection by the thermistors 390 and 391 (S23).

Then, CPU 32 determines whether or not the difference between the temperatures detected by the thermistors 390 and 391 and 231, one for one, in S23 is no more than a preset value, which is 80° C. (S24). If it is no more than the preset value, that is, 80° C., (YES in S24), it returns to S23, in which it obtains the result of temperature detections by the thermistors 390 and 391, for the second time, while keeping the fixation belt 310 stationary. In this case, by the way, it is preferred that the pressure roller 330 is kept separated from the fixation belt 310.

On the other hand, the difference between the temperatures detected by the thermistors 390 and 391, one for one, becomes greater than the preset value, that is, 80° C. (NO in S24), the CPU 32 restarts the driving of the fixing apparatus 8A. That is, it restarts the rotation of the fixation belt 310 (S25). In this case, it is desired that the pressure roller 330 is kept in contact with the fixation belt 310. Then, as a preset length of time, which is 15 seconds, here, elapses after the restarting of the driving of the fixing apparatus 8A (S26), the CPU 32 stops the driving of the fixing apparatus 8A. That is, it stops the rotation of the fixation belt 310 (S27).

As described above, as the CPU 32 receives a command to stop the rotation of the fixation belt 310, it stops the driving of the fixation belt 310. Then, if the difference between the temperatures detected by the thermistors 390 and 391, one for one, is no less than a preset value, it restarts the rotation of the fixation belt 310, and stops the rotation after the elapse of a preset length of time. This practice can prevent the fixation belt 310 from being partially thermally distorted by the nonuniformity, in temperature, of the fixation belt 310 in its rotational direction. Therefore, it is possible to prevent the fixation belt 310 from buckling due to its thermal distortion. Therefore, it is possible to prevent the image forming apparatus 1 from forming unsatisfactory images attributable to the buckling of the fixation belt 310. In addition, it is possible to prevent the fixation belt 310 from being unnecessarily rotated. There fore, it is possible to extend the fixation belt 310 in life expectancy.

By the way, in this embodiment, the temperature of the heat roller 340 was detected by the thermistor 390. However, the control described above may be executed based on the temperature of the portion of the outward surface of the fixation belt 310 which is in contact with the heat roller 340. That is, the temperature of the portion of the fixation belt 310 which is in contact with the heat roller 340 which is one of the suspending-tensioning members, may be substituted by the temperature of the heat roller 340 itself, or the temperature of the portion of the outward surface of the fixation belt 310 which is in contact with the heat roller 340. "Outward surface of the fixation belt 310 which is in contact with the heat roller 340" means the portion of the outward surface of the fixation belt 310, in terms of the rotational direction of the fixation belt 310, which is between the upstream and downstream edges of the portion of the fixation belt 310, which is in contact with the heat roller 340. In this case, the thermistor 390 is placed in contact with, or in the adjacencies of, the portion of the outward surface of the fixation belt 310, which is in the aforementioned range.

Further, in this embodiment, the fixing member, with which an unfixed toner image on recording medium comes into contact, was in the form of a belt. However, the above described control is also compatible with a fixing apparatus structured so that its pressing member which forms a nip between itself and the fixing member of the apparatus is in the form of a belt.

Also in this embodiment, if the CPU 32 receives a command to start the rotation of the fixation belt 310 while continuing the rotation of the fixation belt 310 after the restarting of the fixation belt 310 as described above with reference to FIG. 12, it continues the rotation of the fixation belt 310, without stopping the rotation of the fixation belt 310. For example, if the CPU 32 receives a command to come out of "sleep", before a preset length of time elapse after the restarting of the rotation of the fixation belt 310, it continues the rotation without stopping the rotation even after the elapse of the present length of time, without stopping the rotation.

Embodiment 3

Figure 17:
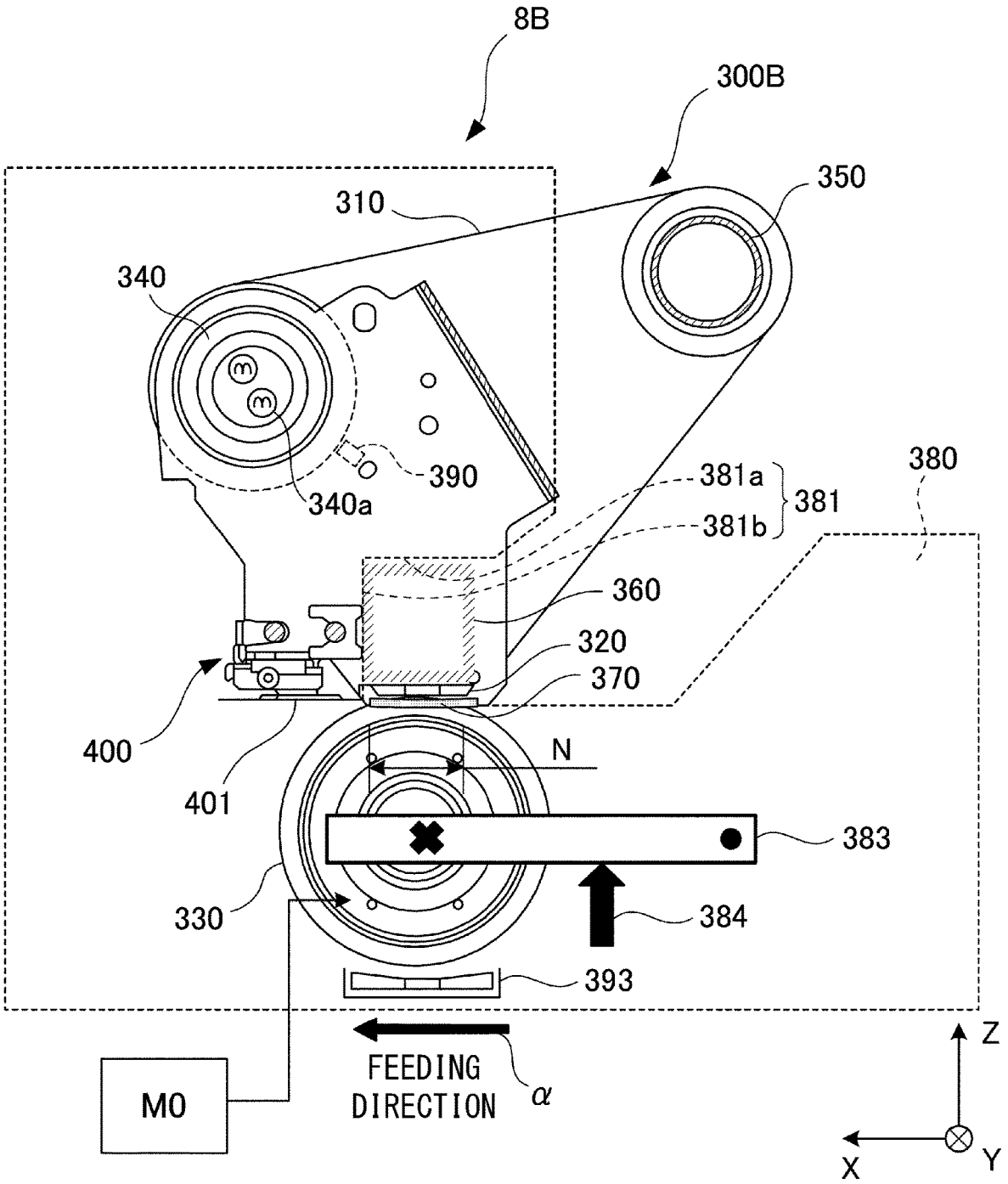
FIG. 17 is a schematic sectional view of the fixing apparatus in the third embodiment of the present invention.
Figure 18:
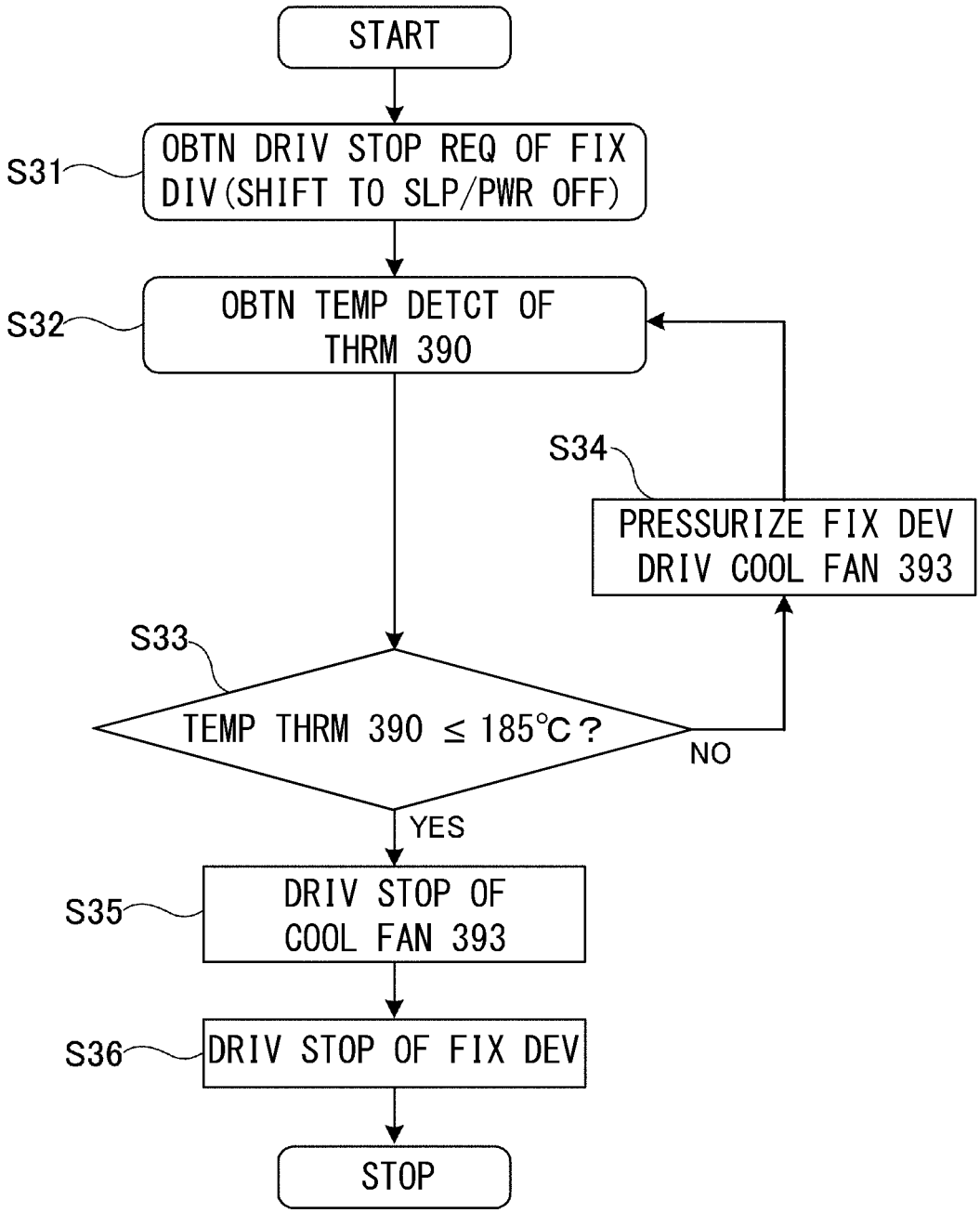
FIG. 18 is a flowchart of the control sequence which is carried out while the driving of the fixing apparatus in the third embodiment is stopped.
Figure 19:
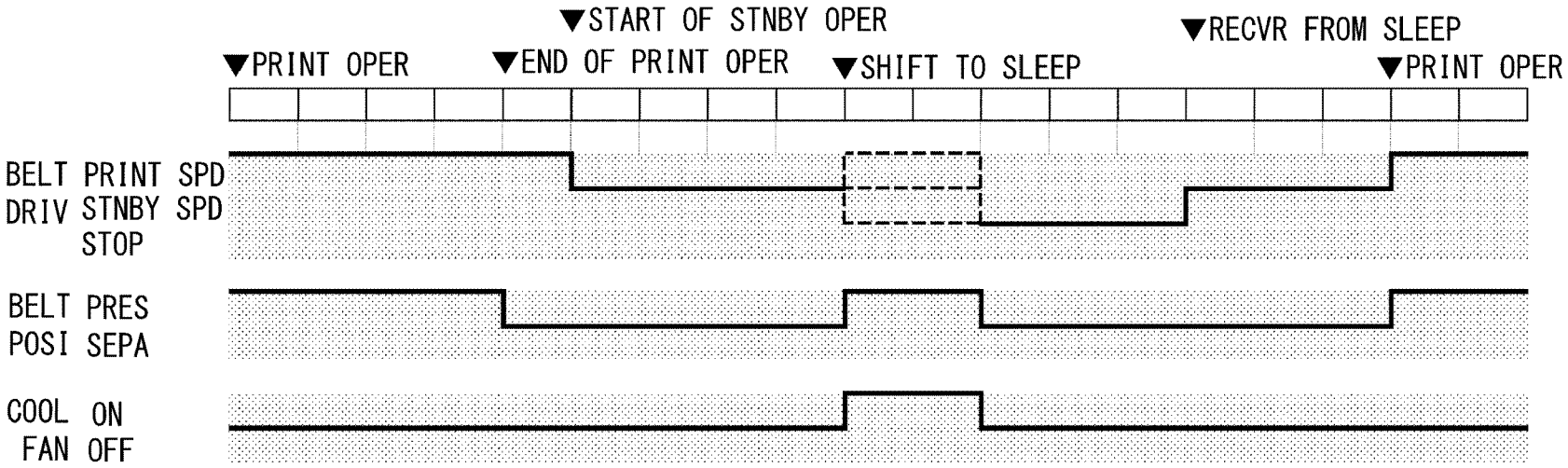
FIG. 19 is a timing chart for driving of the fixing belt, heat roller positioning, and driving of the cooling fan.

Next, referring to FIGS. 17-19, the third embodiment of the present invention is described. In this embodiment, a fixing apparatus is provided with a cooling fan 383 in addition to the components mentioned in the description of the fixing apparatus 8 in the first embodiment given above. The cooling fan 383 blows air toward the pressure roller 330. Otherwise, the fixing apparatus in this embodiment is the same in structure and function as the one in the first embodiment. Therefore, the structural components of the fixing apparatus in this embodiment, which are the same in structure and function as the counterparts in the first embodiment are given the same referential codes as those given to the counterparts, and are not described here. Hereafter, the portions of the fixing apparatus in this embodiment, which are different from the counterparts in the first embodiment are primarily described.

In the fixing apparatus 8B, a cooling fan 393 is disposed on the opposite side of the nip N from the pressure roller 330, being enabled to cool the pressure roller 330. More concretely, referring to FIG. 17, the cooling fan 383 is positioned below the pressure roller 330 in terms of the vertical direction. It is turned on to increase the speed with which the pressure roller 330 reduces in temperature, during continuous driving of the fixation belt 310.

That is, as the CPU 32 (FIG. 4) receives a command to stop the rotation of the fixation belt 310, it detects the temperature of the fixation belt 310. If the temperature detected by the thermistor 390 is higher than a preset value, the CPU 32 starts driving the cooling fan 383. As soon as the detected temperature falls below the preset value, it stops the driving of the cooling fan 383. That is, in this embodiment, the cooling fan 383 is turned on during a period in which the fixation belt 310 is continuously driven as in the first embodiment.

Next, referring to FIG. 18, the control sequence which is to be carried out as soon as the driving of the fixation belt 310 is stopped is described. First, as soon as the CPU 32 receives a command to stop driving the fixing apparatus 8B, that is, a command to stop rotating the fixation belt 310 (S31), it obtains the result of temperature detection by the thermistor 390 (S32). "The CPU 32 obtains a command to stop driving the fixing apparatus 8B" means that the CPU 32 receives a signal to put the fixing apparatus 8B to sleep, and a signal to turn off the electrical power source. If it receives a command to stop driving the fixing apparatus 8B, the pressure roller 330 may be kept separated from, or in contact with, the fixation belt 310.

The CPU 32 determines whether or not the results of the detection in S32 is no more than a preset value, which here is 185° C. (S33). If the detected temperature is higher than the preset value, that is, 185° C. (NO in S33), the CPU 32 keeps the fixing apparatus 8B in a state in which the pressure roller 330 is kept pressed upon the fixation belt 310, and starts driving the cooling fan 383 (S34). That is, the CPU 32 continues the rotation of the fixation belt 310 and drives the cooling fan 383, while keeping the pressure roller 330 in contact with the fixation belt 310. By the way, if the pressure roller 330 is not in contact with the fixation belt 310, the CPU 32 places the pressure roller 330 in contact with the fixation belt 310. Then, it returns to S32, in which it again obtains the result of the temperature detection by the thermistor 390.

On the other hand, if the temperature detected in S32 is no more than the preset value, that is, 185° C. (YES in S33), and the cooling fan 383 is on, the CPU 32 stops the driving of the cooling fan 393, and separates the pressure roller 330 from the fixation belt 310, and also, stops the driving of the cooling fan 383. Further, it stops the driving of the fixing apparatus 8B. That is, it stops the rotation of the fixation belt 310 (S36).

As described above, if the CPU 32 receives a command to stop the rotation of the fixation belt 310, and the temperature detected by the thermistor 390 is higher than the preset value, the CPU 32 continues the rotation of the fixation belt 310, and begins to drive the cooling fan 383. By the way, in this embodiment, the preset temperature value was 185° C. However, it may a value which is no more than 200° C. That is, the fixing apparatus 8A (image forming apparatus 1) may be designed so that the temperature of the fixation belt 310 detected at the moment when the fixation belt 310 was stopped is no more than 200° C., the CPU 32 begins to drive the cooling fan 383, whereas if it is no more than 200° C., the CPU 32 does not drive the cooling fan 383.

Next, referring to FIG. 19 (timing chart), the control of the driving of the fixation belt is described. The belt driving sequence shown in FIG. 19 is the same as the above described one shown in FIG. 11. Referring to FIG. 19, as a printing operation ends, the CPU 32 separates the pressure roller 330 from the fixation belt 310. Then, if it receives a signal to put the fixing apparatus 8B in the state of being asleep, it determines whether or not the driving of the fixation belt 310 and cooling fan 383 is to be continued, based on the result of the temperature detection carried out by the thermistor 390 when it received a signal to put the fixing apparatus 8B in a state of being asleep. In a case where the CPU 32 continues the driving of the fixation belt 310 and begins to drive the cooling fan 383, it places the pressure roller 330 in contact with the fixation belt 310. Then, if the temperature detected by the thermistor 390 falls below the preset value, it stops the driving of the fixation belt 310, separates the pressure roller 330 from the fixation belt 310, and stops the cooling fan 383.

As described above, in this embodiment, if the temperature detected by the thermistor 390 at the moment when the driving of the fixation belt 310 is stopped is no less than the preset value, not only does the CPU 32 continue the rotation of the fixation belt 310, but also, begins to drive the cooling fan 383. Therefore, it is possible to prevent the fixation belt 310 from being made nonuniform in temperature. Therefore, it is possible to prevent the fixation belt 310 from becoming nonuniform in thermal expansion. Therefore, it is possible to prevent the fixation belt 310 from becoming distorted. Therefore, it is possible to prevent the fixation belt 310 from buckling. Therefore, it is possible to prevent the problem that the image forming apparatus 1 forms unsatisfactory images due to the thermal bucking of the fixation belt 310. Moreover, in this embodiment, the fixation belt 310 is cooled faster by the driving of the cooling fan 383. Therefore it is ensured that the fixation belt 310 is not distorted by its nonuniformity in temperature.

By the way, in this embodiment, the pressure roller 330 was cooled by the cooling fan 383. However, a fixing apparatus may be structured so that the cooling fan 383 cools the fixation belt 310, or both the pressure roller 330 and fixation belt 310. In essence, all that is necessary is that a cooling fan is such a fan that blows air toward at least one of the fixation belt 310, and the pressure roller 330 as a rotational member.

Further, in this embodiment, the control of the cooling fan 383 is combined with the control of the fixing apparatus in the first embodiment. However, the control of the cooling fan 383 may be combined with the control in the second embodiment. In such a case, as the CPU 32 receives a command to stop the rotation of the fixation belt 310, it stops the rotation of the fixation belt 310. Then, if the difference between the temperatures detected by the thermistors 390 and 391 (FIG. 14) becomes greater than the preset value, it starts driving the cooling fan 383. Then, it stops the driving of the cooling fan 383 when stopping the rotation of the fixation belt 310. For example, it stops also the driving of the cooling fan 383 after the elapse of a preset length of time after the restarting of the driving of the fixation belt 310.

Embodiment 4

Figure 20:
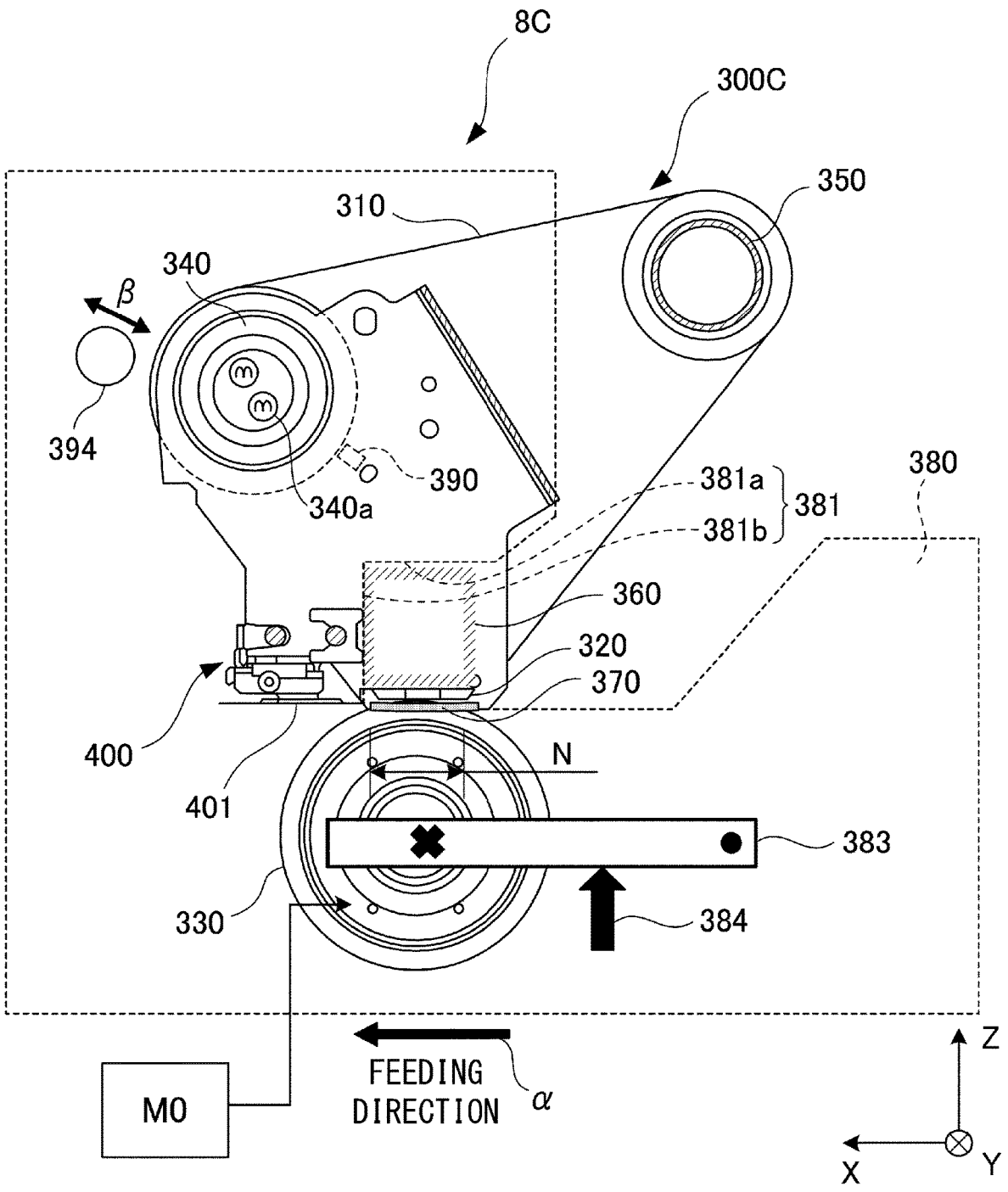
FIG. 20 is a schematic sectional view of the fixing apparatus in the fourth embodiment of the present invention.
Figure 21:
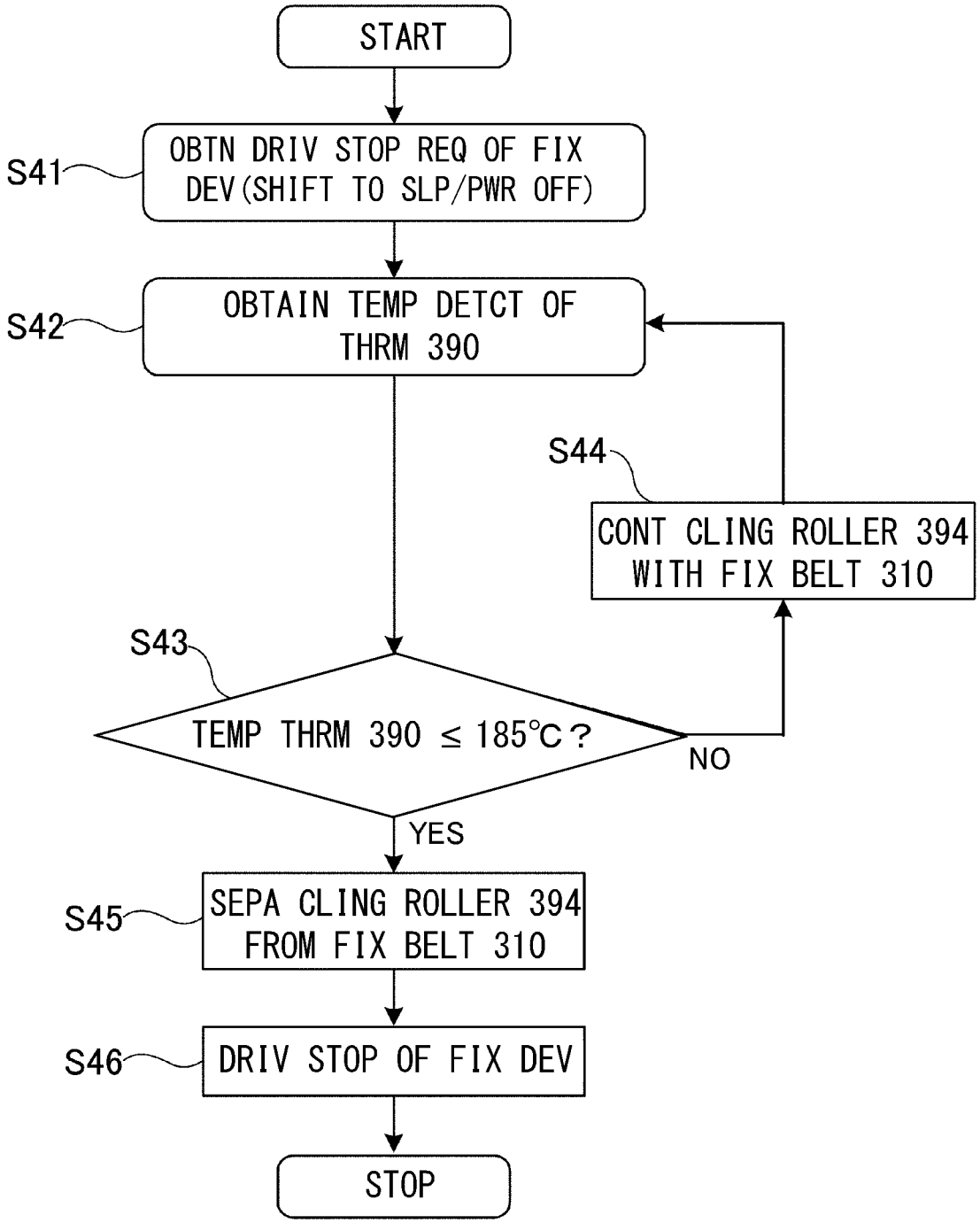
FIG. 21 is a flowchart for the control sequence which is carried out while the driving of the fixing apparatus in the fourth embodiment is stopped.
Figure 22:
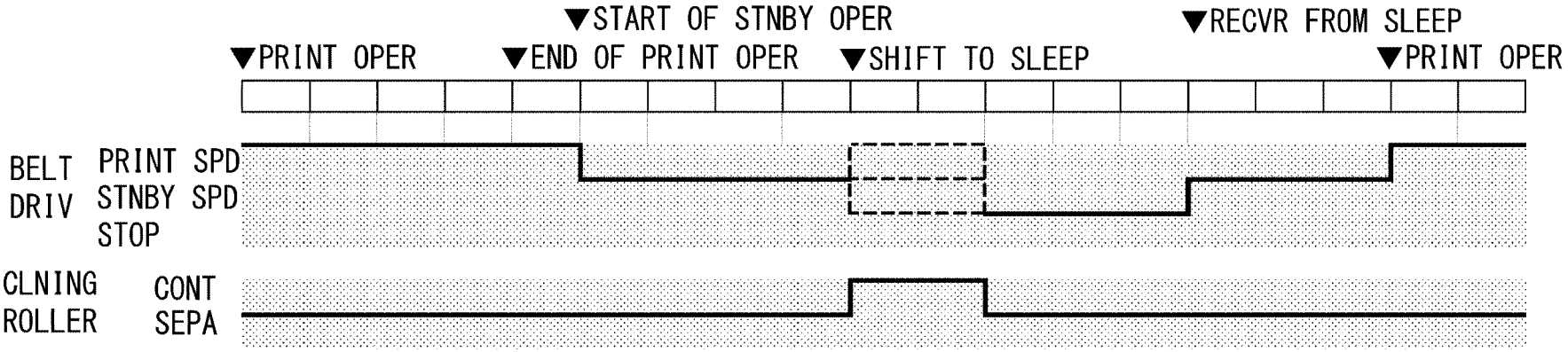
FIG. 22 is a timing chart for the driving of the fixing belt, and cleaning belt positioning, in the fourth embodiment.

Next, referring to FIGS. 20-22, the fourth embodiment of the present invention is described. In this embodiment, a fixing apparatus is provided with a cleaning roller 394 for cleaning the outward surface of the fixation belt 310, in addition to the structural components of the fixing apparatus in the first embodiment. Otherwise, the fixing apparatus in this embodiment is the same in structure and function as the fixing apparatus in the first embodiment. Therefore, the components, portions thereof, etc. of the fixing apparatus in this embodiment, which are the similar in structure and/or function as the counterparts in the first embodiment are given the same referential codes as those given to the counterparts, and are not described here. Thus, this embodiment is described primarily about its difference from the first one.

The fixing apparatus 8C of the heating unit 300C in this embodiment is provided with a cleaning roller 394 as a member which can be placed in contact with, or separated from the outward surface of the portion of the fixation belt 310, which is in contact with the heat roller 340. Referring to FIG. 20, the cleaning roller 394 is positioned so that when it is in contact with the fixation belt 310, it keeps the fixation belt 310 pinched between itself and heat roller 340.

The cleaning roller 394 described above is placed in contact with, or separated from, the outward surface of the fixation belt 310 by an unshown mechanism. When it is in contact with the fixation belt 310, it cleans the outward surface of the fixation belt 310. That is, it is possible that while the fixing apparatus 8C is operated, unwanted substances such as toner and paper dust will adhere to the fixation belt 310. In this embodiment, therefore, the cleaning roller 394 is placed in contact with the fixation belt 310, periodically or with preset timing, to clean the outward surface of the fixation belt 310. More concretely, the cleaning roller 394 is placed in contact with the fixation belt 310 and rotated to clean the outward surface of the fixation belt 310 for every preset number of prints, or as the fixing apparatus 8C is jammed with recording medium.

Also in this embodiment, while the fixation belt 310 is driven, the cleaning roller 394 is kept in contact with the fixation belt 310 to keep the fixation belt 310 lower in temperature. That is, as the CPU 32 (FIG. 4) receives a command to stop the rotation of the fixation belt 310, it obtains the temperature detected by the thermistor 390. If the obtained temperature is higher than a preset value, it places the cleaning roller 394 in contact with the fixation belt 310. Then, as the detected temperature falls below the preset value, it separates the cleaning roller 394 from the fixation belt 310. In this embodiment, therefore, when the CPU 32 stops the rotation of the fixation belt 310, it places and keeps the cleaning roller 394 in contact with the fixation belt 310 during a period which is equivalent to the period in which the CPU 32 continued the driving of the fixation belt 310 in the first embodiment.

Next, referring to FIG. 21, the control which begins to be carried as the driving of the fixation belt 310 is stopped is described about its flow. As the CPU 32 receives a command to stop the driving of the fixing apparatus 8C, that is, as the CPU 32 obtains a command to stop the rotation of the fixation belt 310 (S41), it obtains the result of the temperature detection by the thermistor 390 (S42). "The CPU 32 obtains a command to stop the rotation of the fixing apparatus 8C" means that the CPU 32 receives a signal to put the fixing apparatus 8C to sleep, or a signal to turn off the electric power source. The image forming apparatus 1 (fixing apparatus 8C) may be designed so that as the CPU 32 obtains a command to stop the driving of the fixing apparatus 8C, it keeps the pressure roller 330 separated from the fixation belt 310, or in contact with the fixation belt 310.

The CPU 32 determines whether or not the result detected in S42 is no more than the preset value, which here is 185° C. (S43). If the detected temperature is higher than the preset value, that is, 185° C. (No in S43), the CPU 32 places the cleaning roller 394 in contact with the fixation belt 310 (S44). That is, the CPU 32 continues the rotation of the fixation belt 310, and places the cleaning roller 394 in contact with the fixation belt 310. Then, it goes back to S42, in which it obtains the result of the temperature detection by the thermistor 390.

On the other hand, if the temperature detected in S42 is no more than the preset value, that is, 180° C. (YES in S42), and the cleaning roller 394 is in contact with the fixation belt 310, the CPU 32 separates the cleaning roller 394 from the fixation belt 310 (S45). Further, it stops the driving of the fixing apparatus 8C. That is, it stops the rotation of the fixation belt 310 (Substrate 46).

As described above, if the temperature detected by the thermistor 390 when the CPU 32 received a command to stop the rotation of the fixation belt 310 is higher than the preset value, not only does the CPU 32 continue the rotation of the fixation belt 310, but also, places the cleaning roller 394 in contact with the fixation belt 310. By the way, in this embodiment, the preset temperature value was 185° C. However, it may be a value which is no more than 200° C. That is, the image forming apparatus 1 (fixing apparatus 8C) may be designed so that if the temperature detected when the rotation of the fixation belt 310 is stopped is no less than 200° C., the CPU 32 places the cleaning roller 394 in contact with the fixation belt 310, whereas if the temperature is no more than 200° C., the CPU 32 leaves the cleaning roller 394 separated from the fixation belt 310.

Next, referring to FIG. 22 (timing chart), an example of control of driving of a fixation belt is described. The driving of a fixation belt, shown in Figure, is the same as the one shown in FIG. 11. Referring to FIG. 22, as the CPU 32 receives a signal to put the fixing apparatus 8C to sleep, the CPU 32 determines whether or not the driving of the fixation belt 310 is to be continued, and the cleaning roller 394 is to be placed in contact with the fixation belt 310, based on the result of the temperature detection by the thermistor 390. Then, it continues the driving of the fixation belt 310, places the cleaning roller 394 in contact with the fixation belt 310. As the temperature detected by the thermistor 390 falls below the preset value, the CPU 32 stops the driving of the fixation belt 310, and separates the cleaning roller 394 from the fixation belt 310.

As described above, in this embodiment, if the temperature detected by the thermistor 390 when the driving of the fixation belt 310 was stopped is higher than the preset value, not only does the CPU 32 continue the rotation of the fixation belt 310, but also, places the cleaning roller 394 in contact with the fixation belt 310. Therefore, it is possible to prevent the fixation belt 310 from becoming abnormally nonuniform in temperature. Therefore, it is possible to prevent the fixation belt 310 from becoming nonuniform in thermal expansion. Therefore, it is possible to prevent the fixation belt 310 from becoming distorted due to its nonuniformity in thermal expansion. Therefore, it is possible to prevent the fixation belt 310 from suffering from the buckling attributable to its nonuniformity in thermal expansion. Therefore, it is possible to prevent an image forming apparatus from outputting unsatisfactory images attributable to the bucking of the fixation belt, which is attributable to the nonuniformity in the temperature of the fixation belt 310. Moreover, in this embodiment, the cleaning roller 394 is placed in contact with the fixation belt 310 to promote the cooling of the fixation belt 310. Therefore, it is possible to ensure that the fixation belt 310 is prevented from partially distorting due to its nonuniform thermal expansion.

By the way, in this embodiment, the cleaning member for cleaning the fixation belt 310 was a cleaning roller. However, a cleaning member which can be placed in contact with, or separated from, the fixation belt 310 may be a web or the like formed of unwoven cloth. Further, the member which can be placed in contact with, or separated from the fixation belt 310 may be a polishing member for polishing the surface of he fixation belt 310, or a member which is capable of making the fixation belt 310 uniform in temperature in terms of the lengthwise direction of the fixation belt 310. Moreover, it may be such a member that can be placed in contact with the inward surface of the fixation belt 310 to apply lubricant to the fixation belt 310.

Further, in this embodiment, the control of the fixing apparatus is a combination of the control in the first embodiment, and the control of the member which is placed in contact with, or separated from the fixation belt 310. However, the control of the fixing apparatus may be a combination of the control in the second embodiment, and the control of the member which can be placed in contact with, or separated from, the fixation belt 310. In such a case, as the CPU 32 receives a command to stop the rotation of the fixation belt 310, it stops the rotation of the fixation belt 310. Then, if the difference between the temperatures detected by the thermistors 390 and 391 (FIG. 14) becomes larger than a preset value, the CPU 32 places a member which can be placed in contact with, or separated from, the fixation belt 310, in contact with the fixation belt 310. For example, the CPU 32 separates the member which can be placed in contact with, or separated from the fixation belt 310, from the fixation belt 310, for a preset length of time after the restarting of the driving of the fixation belt 310.

Miscellanies

The third and fourth embodiments described above may be combined. For example, in a case where the first embodiment is combined with the third and fourth embodiments, not only does the CPU 32 drive the cooling fan 383 while it continues the driving of the fixation belt 310 as in the first embodiment, but also it places the member which can be placed in contact with, or separated from, the fixation belt 310, in contact with the fixation belt 310. Further, in a case where the second embodiment is combined with the third and fourth embodiment, not only does the CPU 32 start driving the cooling fan 383, but also, it places the member which can be placed in contact with, or separated from the fixation belt 310, in contact with the fixation belt 310, when it restarts the driving of the fixation belt 310.

In the embodiments described above, the image forming apparatus 1 (fixing apparatus 8) was structured so that if the temperature of the fixation belt, or that of the heat roller, had not reached a preset value when the CPU 32 received a signal to turn off an electrical power source, or a signal to put the fixing apparatus to sleep, the CPU 32 stops the driving of the fixation belt if the temperature of the fixation belt, or the temperature of the heat roller reaches a preset condition. In comparison, an image forming apparatus (fixing apparatus) may be structured so that if the temperature of the fixation belt or temperature of the heat roller has not reached a preset condition when the CPU of the image forming apparatus received a signal to turn of the electrical power source, or a signal to put the apparatus in the sleep mode, the CPU continues the rotation of the fixation belt for a preset period (length of time), and then, stops the rotation of the fixation belt after the elapse of a preset length of time.

Further, in the embodiments described above, the fixing apparatus was structured so that its fixation belt was suspended and kept tension by a combination of a fixation pad, an auxiliary drive roller, and a steering roller. However, these embodiments are not intended to limit the present invention in scope in terms of how a fixation belt is suspended and tensioned. For example, the present invention is also applicable to a fixing apparatus structured so that its fixation belt is suspended and tensioned by a combination of only a single suspension-tension roller and a fixation pad. In essence, all that is required for the present invention to be applicable to a fixing apparatus is that the fixing apparatus is provided with a fixation pad, and at least one belt suspending-tensioning roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-063489 filed Mar. 31, 2020 which is hereby incorporated by reference herein in its entirety.

What is claimed is:

1. An image forming apparatus comprising:

a rotatable belt configured to fix a toner image on a recording material;

a pressing member configured to feed and nip the recording material with said belt;

a heating roller including a heater inside and configured to suspend and tension, and heat said belt;

a temperature detecting member configured to detect a temperature of said heating roller or a temperature of said belt at an area where said belt is into contact with said heating roller;

a suspending-tensioning member configured to stretch said belt;

a drive source configured to rotate said belt;

a control portion configured to control said drive source; and a receiving portion configured to receive a power OFF signal of said image forming apparatus, wherein said control portion, in a case in which the temperature detected by said temperature detecting member does not reach a predetermined condition when said receiving portion receives the OFF signal of said image forming apparatus during a rotation of said belt, controls to de-energize said heater and to continue the rotation of said belt, and then controls to turn off the power of said image forming apparatus in a case in which the temperature detected by said temperature detecting member reaches the predetermined condition.

2. An image forming apparatus according to claim 1, wherein the predetermined condition is that the temperature detected by said temperature detecting member is below a predetermined temperature.

3. An image forming apparatus according to claim 1, wherein said driving source rotates said belt in a standby state in which an image formation operation is standby.

4. An image forming apparatus according to claim 1, wherein said control portion, in a case in which the temperature detected by said temperature detecting member reaches the predetermined condition when said receiving portion receives the OFF signal of said image forming apparatus during the rotation of said belt, controls to stop the rotation of said belt and to turn off the power of said image forming apparatus.

5. An image forming apparatus according to claim 1, wherein said temperature detecting member is a first temperature detecting member, and said image forming apparatus comprises a second temperature detecting member configured to detect a temperature of a surface where said belt is stretched, and wherein the predetermined condition is that a difference between the temperature detected by said first temperature detecting member and the temperature detected by said second temperature detecting member is below a predetermined temperature.

6. An image forming apparatus according to claim 1, further comprising a pad member configured to stretch said belt and to press (pressurize) said pressing member through said belt.

7. An image forming apparatus according to claim 1, wherein said drive source rotates said pressing member and said pressing member rotates said belt through the nip portion.

8. An image forming apparatus according to claim 1, wherein said drive source rotates said heating roller.

9. An image forming apparatus comprising:

a rotatable belt configured to fix a toner image on a recording material;

a pressing member configured to feed and nip the recording material with said belt;

a heating roller including a heater inside and configured to suspend and tension, and heat said belt;

a temperature detecting member configured to detect a temperature of said heating roller or a temperature of said belt at an area where said belt is into contact with said heating roller;

a suspending-tensioning member configured to stretch said belt;

a drive source configured to drive to rotate said belt;

a control portion configured to control said drive source; and a receiving portion configured to receive a switch signal switching said image forming apparatus from a standby state in which an image formation operation is standby to a sleep state in which the image formation operation is standby and said image forming apparatus is at a lower power than in the standby state, wherein said control portion, in a case in which the temperature detected by said temperature detecting member does not reach a predetermined condition when said receiving portion receives the switch signal during a rotation of said belt, controls to de-energize said heater and to continue the rotation of said belt, and then controls to switch said image forming apparatus to the sleep state in a case in which the temperature detected by said temperature detecting member reaches the predetermined condition.

10. An image forming apparatus according to claim 9, wherein the predetermined condition is that the temperature detected by said temperature detecting member is below a predetermined temperature.

11. An image forming apparatus according to claim 9, wherein said driving source rotates said belt in the standby state.

12. An image forming apparatus according to claim 9, wherein said control portion, in a case in which the temperature detected by said temperature detecting member reaches the predetermined condition when said receiving portion receives the switch signal during the rotation of said belt, controls to stop the rotation of said belt and to switch said image forming apparatus to the sleep state.

13. An image forming apparatus according to claim 9, wherein said temperature detecting member is a first temperature detecting member, and said image forming apparatus comprises a second temperature detecting member configured to detect a temperature of a surface where said belt is stretched, and wherein the predetermined condition is that a difference between the temperature detected by said first temperature detecting member and the temperature detected by said second temperature detecting member is below a predetermined temperature.

14. An image forming apparatus according to claim 9, further comprising a pad member configured to stretch said belt and to press (pressurize) said pressing member through said belt.

15. An image forming apparatus according to claim 9, wherein said drive source rotates said pressing member and said pressing member rotates said belt through the nip portion.

16. An image forming apparatus according to claim 9, wherein said drive source rotates said heating roller.

17. An image forming apparatus comprising:

a rotatable belt configured to fix a toner image on a recording material;

a pressing member configured to feed and nip the recording material with said belt;

a heating roller including a heater inside and configured to suspend and tension, and heat said belt;

a temperature detecting member configured to detect a temperature of said heating roller or a temperature of said belt at an area where said belt is into contact with said heating roller;

a suspending-tensioning member configured to stretch said belt;

a drive source configured to drive to rotate said belt;

a control portion configured to control said drive source; and a receiving portion configured to receive a power OFF signal of said image forming apparatus, wherein said control portion, when said receiving portion receives the OFF signal of said image forming apparatus during a rotation of said belt, determines whether to continue the rotation of said belt or to stop the rotation of said belt and to turn off the power of said image forming apparatus based on the temperature detected by said temperature detecting member.

18. An image forming apparatus comprising:

a rotatable belt configured to fix a toner image on a recording material;

a pressing member configured to feed and nip the recording material with said belt;

a heating roller including a heater inside and configured to suspend and tension, and heat said belt;

a temperature detecting member configured to detect a temperature of said heating roller or a temperature of said belt at an area where said belt is into contact with said heating roller;

a suspending-tensioning member configured to stretch said belt;

a drive source configured to drive to rotate said belt;

a control portion configured to control said drive source; and a receiving portion configured to receive a switch signal switching said image forming apparatus from a standby state in which an image formation operation is standby to a sleep state in which the image formation operation is standby and said image forming apparatus is at a lower power than in the standby state, wherein said control portion, when said receiving portion receives the switch signal during a rotation of said belt, determines whether to continue the rotation of said belt or to stop the rotation of said belt and to turn off the power of said image forming apparatus based on the temperature detected by said temperature detecting member.

* * * * *